US006119291A

United States Patent [19]

Osborne et al.

[11] Patent Number: 6,119,291

[45] Date of Patent: Sep. 19, 2000

[54] PERCUSSION AND VIBRATION THERAPY APPARATUS

[75] Inventors: Eugene E. Osborne, Hebron, Ky.; Scott D. McCormick, Cincinnati; Stephen R. Schulte, Harrison, both of Ohio; David J. Ulrich, Sunman, Ind.; Dan Mansfield, Chattanooga, Tenn.; John Vodzak, Batesville, Ind.; Mike Frondorf, Lakeside Park, Ky.

[73] Assignee: Hill-Rom, Inc., Batesville, Ind.

[21] Appl. No.: 09/210,120

[22] Filed: Dec. 11, 1998

Related U.S. Application Data

[63] Continuation-in-part of application No. 08/935,689, Sep. 23, 1997, Pat. No. 6,047,424, which is a continuation-in-part of application No. 08/852,361, May 7, 1997, Pat. No. 5,781,949, which is a division of application No. 08/511,542, Aug. 4, 1995, Pat. No. 5,630,238.

[51] Int. Cl.[7] ..... A47C 27/10; A61G 7/057

[52] U.S. Cl. ..... 5/600; 5/713; 601/55; 601/56; 601/149

[58] Field of Search ..... 5/600, 713, 710, 5/714, 715; 601/55, 149, 56

[56] References Cited

U.S. PATENT DOCUMENTS

| | | |
|---|---|---|
| 1,772,310 | 8/1930 | Hart . |
| 3,492,988 | 2/1970 | DeMare . |
| 3,674,019 | 7/1972 | Grant . |
| 3,867,732 | 2/1975 | Morrell . |
| 4,193,149 | 3/1980 | Welch . |
| 4,224,706 | 9/1980 | Young et al. . |
| 4,394,784 | 7/1983 | Swenson et al. . |
| 4,435,864 | 3/1984 | Callaway . |
| 4,525,409 | 6/1985 | Elesh . |
| 4,628,557 | 12/1986 | Murphy . |
| 4,638,519 | 1/1987 | Hess . |
| 4,803,744 | 2/1989 | Peck et al. . |
| 4,897,890 | 2/1990 | Walker . |
| 4,951,335 | 8/1990 | Eady . |

(List continued on next page.)

OTHER PUBLICATIONS

"The Pillow–Pump® Alternating Pressure System," Gaymar Industries, Inc. advertising brochures, 8 pages, date unknown.

"Grant Dyna–CARE," Grant advertising literature, one page, date unknown.

"ALAMO—Alternating Low Airloss Mattress Overlay," National Patient Care Systems, Inc. advertising literature, one page, date unknown.

"Using Sof•Care® just got easier . . . ", Gaymar Industries, Inc. advertising literature, one page, 1992.

*Primary Examiner*—Alexander Grosz

[57] ABSTRACT

A percussion and vibration apparatus for use in a bed is provided. A pressurized air input port is configured to be coupled to a pressurized air supply system. A valve assembly is coupled to the pressurized air input port. A percussion and vibration bladder port is coupled to the valve assembly and configured to be coupled to at least one percussion and vibration bladder. A controller is coupled to the valve assembly and configured to be coupled to a communication network to regulate flow of pressurized air through the valve assembly from the pressurized air input port to the percussion and vibration bladder port.

39 Claims, 20 Drawing Sheets

U.S. PATENT DOCUMENTS

| | | |
|---|---|---|
| 4,977,633 | 12/1990 | Chaffee . |
| 4,982,466 | 1/1991 | Higgins et al. . |
| 4,986,738 | 1/1991 | Kawasaki et al. . |
| 4,991,244 | 2/1991 | Walker . |
| 4,993,920 | 2/1991 | Harkleroad et al. . |
| 4,999,867 | 3/1991 | Toivio et al. . |
| 5,007,123 | 4/1991 | Salyards . |
| 5,018,786 | 5/1991 | Goldstein et al. . |
| 5,044,364 | 9/1991 | Crowther . |
| 5,052,068 | 10/1991 | Graebe . |
| 5,060,174 | 10/1991 | Gross . |
| 5,062,169 | 11/1991 | Kennedy et al. . |
| 5,068,933 | 12/1991 | Sexton . |
| 5,083,335 | 1/1992 | Krouskop et al. . |
| 5,095,568 | 3/1992 | Thomas et al. . |
| 5,103,519 | 4/1992 | Hasty . |
| 5,142,719 | 9/1992 | Vrzalik . |
| 5,152,021 | 10/1992 | Vrzalik . |
| 5,170,364 | 12/1992 | Gross et al. . |
| 5,179,742 | 1/1993 | Oberle . |
| 5,325,551 | 7/1994 | Tappel et al. . |
| 5,331,698 | 7/1994 | Newkirk et al. . |
| 5,335,384 | 8/1994 | Foster et al. . |
| 5,367,728 | 11/1994 | Chang . |
| 5,375,273 | 12/1994 | Bodine, Jr. et al. . |
| 5,454,126 | 10/1995 | Foster et al. . |
| 5,487,196 | 1/1996 | Wilkinson et al. . |
| 5,539,943 | 7/1996 | Romano . |
| 5,606,754 | 3/1997 | Hand et al. . |
| 5,611,096 | 3/1997 | Bartlett et al. . |
| 5,666,681 | 9/1997 | Meyer et al. . |

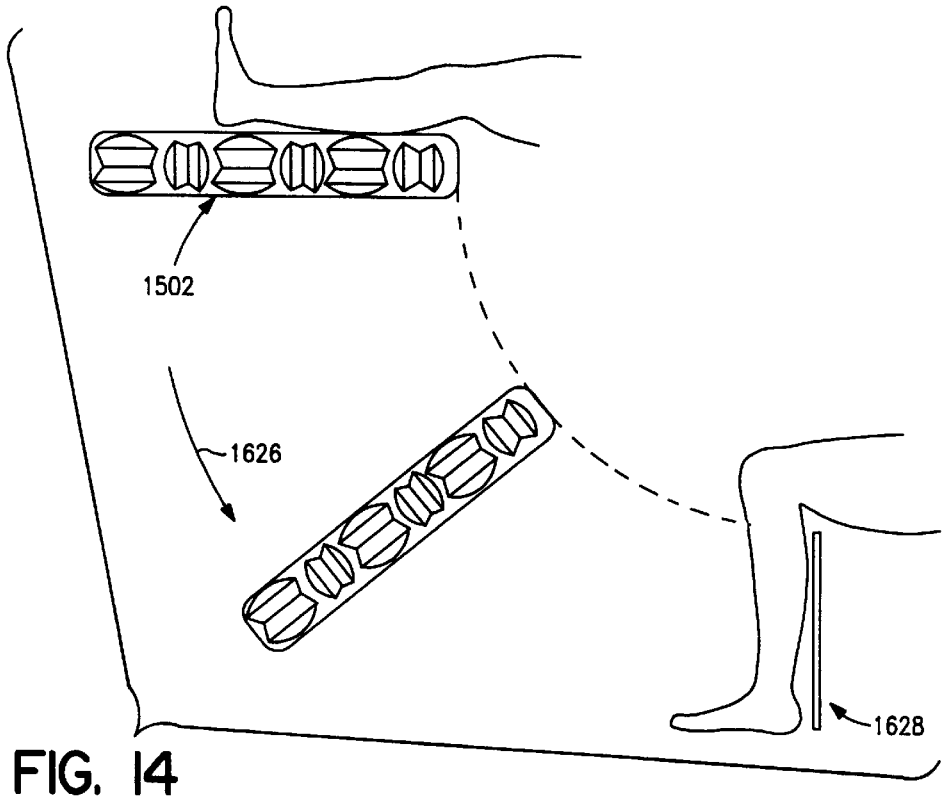
FIG. 14
FIG. 16
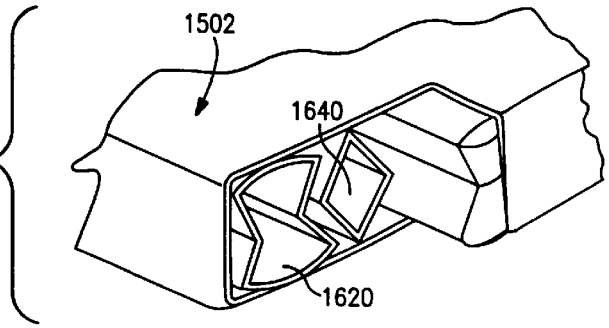
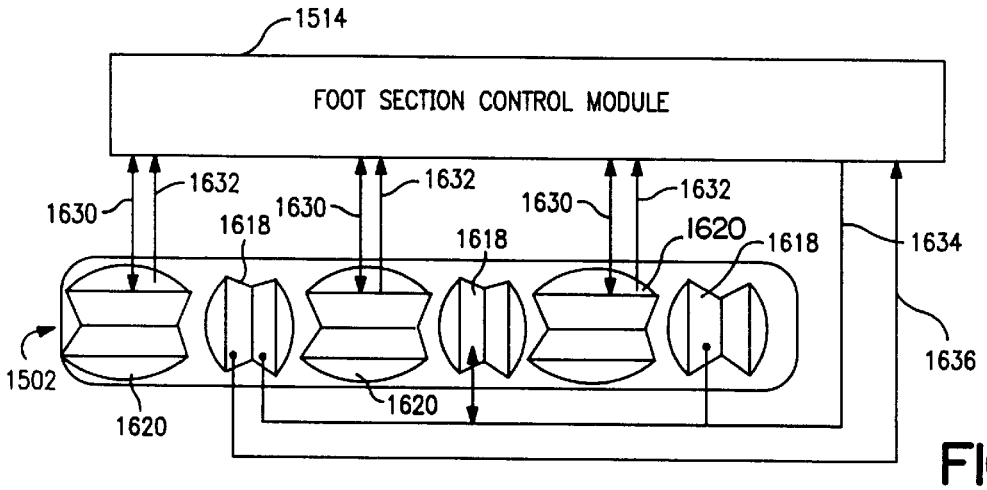
FIG. 15

PERCUSSION AND VIBRATION THERAPY APPARATUS

This application is a continuation-in-part of application serial No. 08/935,689, filed Sep. 23, 1997, now U.S. Pat. No. 6,047,424 which is a continuation-in-part of application Ser. No. 08/852,361, filed May 7, 1997, now U.S. Pat. No. 5,781,949, which is a divisional of Ser. No. 08/511,542, filed Aug. 4, 1995, now U.S. Pat. No. 5,630,238.

BACKGROUND AND SUMMARY OF THE INVENTION

The present invention relates to a bed having modular therapy and support surfaces, and particularly to a hospital bed having an on-board air handling unit and electrical communication network capable of connecting to and controlling a plurality of different modular air therapy and support surfaces for providing a plurality of different therapies or treatments to a patient. More particularly, the present invention relates to a percussion and vibration therapy module for use in such beds.

The present invention provides a plurality of different air therapy and support surfaces, all of which can be connected to the bed to provide a complete therapy line that is rapidly installed or exchanged on demand as census or diagnostic population varies. In an acute care environment, a hospital typically needs decubitus prevention, decubitus treatment (stage one and two minimum), pulmonary therapies including rotation therapy and percussion and vibration therapy, and venous compression therapy capabilities.

The modular therapy and support surface design of the present invention allows several air support surfaces and air therapy devices to be driven by a common air source, a common graphical interactive display device, and a distributed communication network. The modular therapy and surface support system of the present invention is designed to provide a one bed solution for acute care including critical care, step down/progressive care, med-surg, high acuity subacute care, PACU, and sections of ED. The modular therapy and support surface system of the present invention provides therapies that benefit a large percentage of the patient population in an acute care hospital.

The bed of the present invention includes an air handling unit which is illustratively located on a bed frame and which is capable of supplying air pressure and/or a vacuum to all the therapy and support surface modules. Typically, the air handling unit is mounted on the base frame of the bed. Preferably, the air handling unit drives two lines simultaneously for supplying both air pressure and vacuum to the air therapy modules. A header connector is coupled to the air handling unit by a plurality of air lines. The header connector is configured to couple the air handling unit to a selected modular air therapy device support surface.

The modular therapy and support surface components for the different therapies are contained within the sleep surface on the bed, enabling a caregiver to install, initiate, or remove a desired air therapy module from the bed without moving the patient off the original support surface. The modular design of the present invention allows modules for air therapy to have reduced size. Therefore, the modules can be delivered after the bed and stored easily. The air handling unit of the present invention is coupled to therapy control modules that contain air distribution means such as adjustable valves and sensors by a simple connection of pneumatic lines to the control modules.

According to one aspect of the present invention, a percussion and vibration apparatus for use in a bed is provided. The bed includes a pressurized air supply system, at least one percussion and vibration bladder, and an electrical communication network. The percussion and vibration apparatus includes a pressurized air input port configured to be coupled to the pressurized air supply system. A valve assembly is coupled to the pressurized air input port. A percussion and vibration bladder port is coupled to the valve assembly and configured to be coupled to at least one percussion and vibration bladder. A controller is coupled to the valve assembly and configured to be coupled to the communication network to regulate flow of pressurized air through the valve assembly from the pressurized air input port to the percussion and vibration bladder port.

In illustrated embodiments, an exhaust port is coupled to the valve assembly. The valve assembly is configured to regulate flow of air from the percussion and vibration bladder port to the exhaust port. The percussion and vibration bladder port can include a pair of ports. The apparatus further includes a housing with an outside surface and an interior chamber. The valve assembly is coupled to the housing within the chamber. The air input port includes a tube extending from the outside surface of the housing. Similarly, the percussion and vibration bladder port includes a tube extending from the outside surface of the housing.

Illustratively, the valve assembly includes a solenoid coupled to a valve plate for movement of the valve plate between a first position to prevent fluid communication from the air input port to the percussion and vibration bladder port and a second position to permit fluid communication from the air input port to the percussion and vibration bladder port. The valve assembly further includes a spring that biases the valve plate to the first position. An exhaust port is coupled to the valve assembly. The exhaust port is in fluid communication with the percussion and vibration bladder port when the valve plate is in the first position. The valve plate prevents fluid communication from the exhaust port to the percussion and vibration bladder port when the valve plate is in the second position.

In illustrated embodiments, the valve assembly includes a pressure chamber coupled to the pressurized air input port and a bladder chamber coupled to the percussion and vibration bladder port. A valve regulates fluid communication from the pressure chamber to the bladder chamber. An exhaust port is coupled to the bladder chamber, and the valve also regulates fluid communication from the bladder chamber to the exhaust port.

Illustratively, the controller includes an electronic circuit including a microprocessor configured to be coupled to the communication network. The controller is coupled to the valve assembly to regulate fluid communication from the pressurized air input port to the percussion and vibration bladder port. Further illustratively, the bed includes a module-receiving manifold, and the percussion and vibration apparatus includes a latch to secure the apparatus to the manifold.

According to another aspect of the present invention, a percussion and vibration apparatus for use in a bed is provided. Again, the bed includes a pressurized air supply system, at least one percussion and vibration bladder, and an electrical communication network. The percussion and vibration apparatus includes a housing having a pressurized air input port configured to be coupled to the pressurized air supply system and a percussion and vibration bladder port configured to be coupled to at least one percussion and vibration bladder. A valve assembly is coupled to the housing to regulate fluid communication from the pressurized air input port to the percussion and vibration bladder port. A controller is configured to be coupled to the communication network. The controller is coupled to the valve assembly for control thereof.

In illustrated embodiments, the valve assembly includes a solenoid and a valve plate. The valve assembly further includes a valve seat to engage the valve plate to prevent fluid communication from the pressurized air input port to the percussion and vibration bladder port. The valve assembly furthermore includes a bias assembly to bias the valve assembly to prevent fluid communication from the pressurized air input port to the percussion and vibration bladder port. The bias assembly can include a spring to bias the valve plate toward the valve seat. The valve assembly still further includes an exhaust port and a second valve seat to engage the valve plate to prevent fluid communication from the percussion and vibration bladder port to the exhaust port.

According to yet another aspect of the present invention, a percussion and vibration apparatus for use in a bed is provided. Yet again, the bed includes an electrical communication network, a pressurized air supply system, and at least one percussion and vibration bladder. The percussion and vibration apparatus includes a pressurized air input port configured to be coupled to the pressurized air supply system and a percussion and vibration bladder port configured to be coupled to at least one percussion and vibration bladder. Means for regulating fluid communication from the pressurized air input port to the percussion and vibration bladder port is provided. Also provided are means coupled to the communication network for controlling the means for regulating. Illustratively, the means for regulating includes a solenoid coupled to a valve plate.

Additional features of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which:

FIG. 14 is a diagrammatical view further illustrating how the surface foot section retracts or shortens and collapses or thins as the bed moves from the bed position to the chair position;

FIG. 15 is a diagrammatical view of the control module and bladder configuration of the surface foot section;

FIG. 16 is a partial perspective view with portions broken away illustrating another embodiment of the surface foot section;

DETAILED DESCRIPTION OF DRAWINGS

Figure 1:
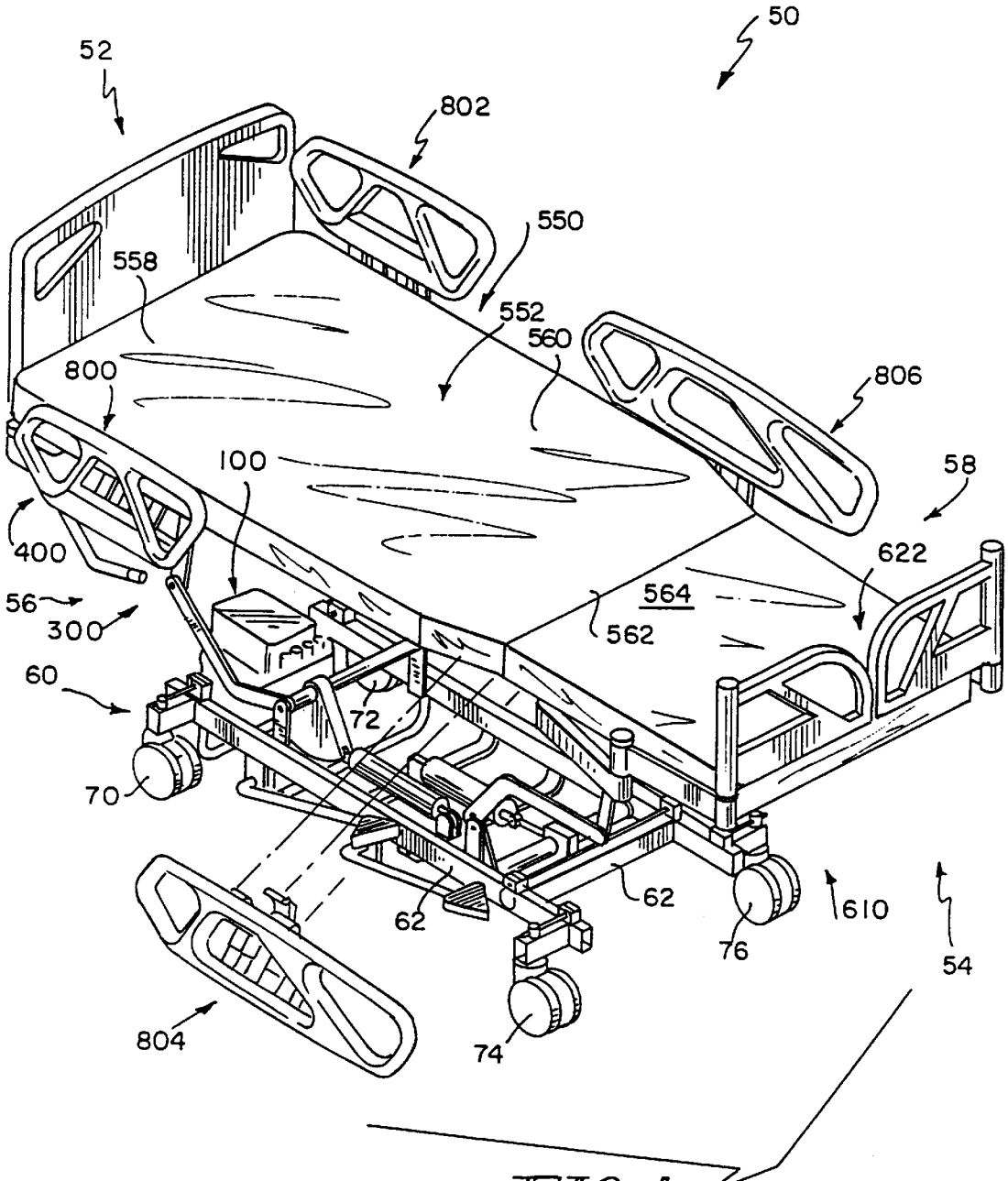
FIG. 1 is a perspective view of a chair bed in accordance with the present invention in a bed position showing a side rail exploded away from the chair bed, head side rails and foot side rails positioned along longitudinal sides of a deck, and a swinging foot gate in a closed position.

A chair bed 50 in accordance with the present invention having a head end 52, a foot end 54, and sides 56, 58 is illustrated in FIG. 1. As used in this description, the phrase "head end 52" will be used to denote the end of any referred-to object that is positioned to lie nearest head end 52 of chair bed 50. Likewise, the phrase "foot end 54" will be used to denote the end of any referred-to object that is positioned to lie nearest foot end 54 of chair bed 50.

Chair bed 50 includes a base module 60 having a base frame 62 connected to an intermediate frame module 300 as shown in FIG. 1. Casters 70, 72, 74 and 76 support the base frame 62. An articulating deck/weigh frame module 400 is coupled to intermediate frame module 300. Side rail assemblies 800, 802, 804, 806 and an extended frame module 610 having a swinging foot gate 622 are coupled to articulating deck/weigh frame module 400. A mattress 550 is carried by articulating deck/weigh frame module 400 and provides a sleeping surface or support surface 552 configured to receive a person (not shown).

Chair bed 50 is manipulated by a caregiver or by a person (not shown) on sleeping surface 552 using hydraulic system module 100 so that mattress 550, an intermediate frame 302 of intermediate frame module 300, and an articulating deck 402 of articulating deck/weigh frame module 400 assume a variety of positions, several of which are shown diagrammatically in FIGS. 3–8.

Articulating deck 402 includes a head section 404, a seat section 406, a thigh section 408, and a foot section 410. Mattress 550 rests on deck 402 and includes a head portion 558, a seat portion 560, a thigh portion 562, and a foot portion 564, each of which generally corresponds to the like-named portions of deck 402, and each of which is generally associated with the head, seat, thighs, and feet of the person on sleeping surface 552.

Figure 3:
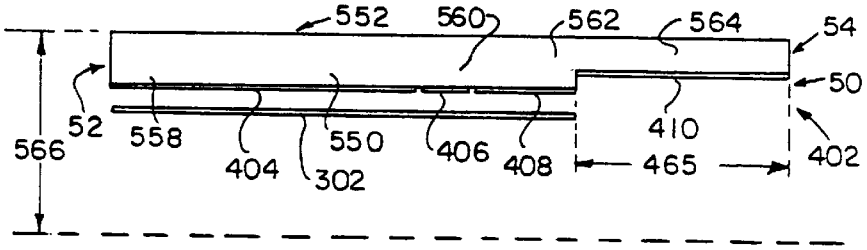
FIG. 3 is a diagrammatic view of the chair bed of FIG. 1 showing the chair bed in the bed position including a mattress having an upwardly-facing sleeping surface held a predetermined first distance above the floor, the deck being in an initial bed position supporting the sleeping surface in a generally planar configuration, and the foot section being a first length.
Figure 4:
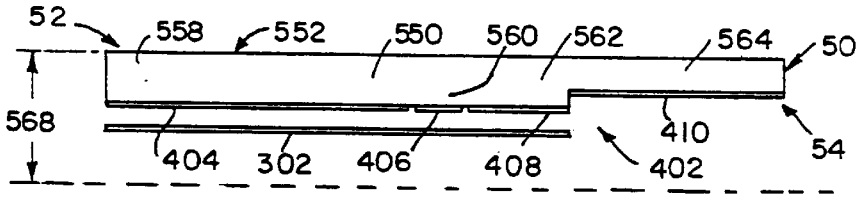
FIG. 4 is a diagrammatic view showing the chair bed in a low position.

Chair bed 50 can assume a bed position having deck 402 configured so that sleeping surface 552 is planar and horizontal, defining an initial position of deck 402 as shown in FIG. 1 and as shown diagrammatically in FIG. 3. In the bed position, sleeping surface 552 is a predetermined first distance 566 above the floor. Chair bed 50 can also be manipulated to assume a low position shown diagrammatically in FIG. 4 having deck 402 in the initial position and having sleeping surface 552 a predetermined second distance 568 above the floor, the second distance 568 being smaller than first distance 566. The foot deck section 410 of the articulating deck 402 includes a pivoting portion 466 and a contracting portion 462. Foot deck section 410 has a first length 465 when the deck 402 is in the initial position.

Figure 5:
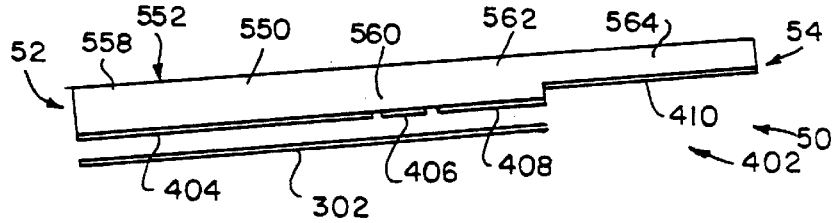
FIG. 5 is a diagrammatic view showing the chair bed in a Trendelenburg position.
Figure 6:
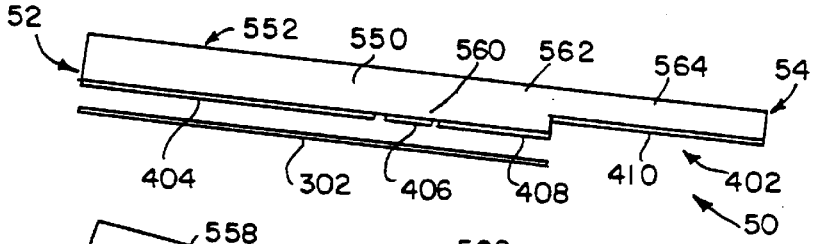
FIG. 6 is a diagrammatic view showing the chair bed in a reverse Trendelenburg position.
Figure 7:
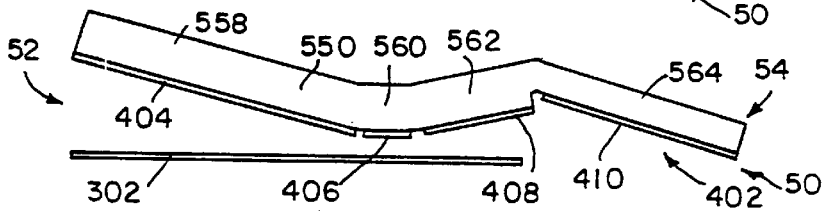
FIG. 7 is a diagrammatic view showing the chair bed in an intermediate position having a head end of a head section of the deck pivoted slightly upward from the initial position of the deck, a seat section positioned to lie in the horizontal plane defined by the seat section in the initial position of the deck, and the foot section being inclined slightly so that the foot end of the foot section lies below the position of the foot section when the deck is in the initial position of the deck.

Chair bed 50 can be moved to a Trendelenburg position shown diagrammatically in FIG. 5 having deck 402 in a planar configuration and tilted so that head end 52 of sleeping surface 552 is positioned to lie closer to the floor than foot end 54 of sleeping surface 552. Chair bed 50 can also achieve a reverse Trendelenburg position shown diagrammatically in FIG. 6 having deck 402 in a planar configuration and tilted so that foot end 54 of sleeping surface 552 is positioned to lie closer to the floor than head end 52 of sleeping surface 552.

Figure 2:
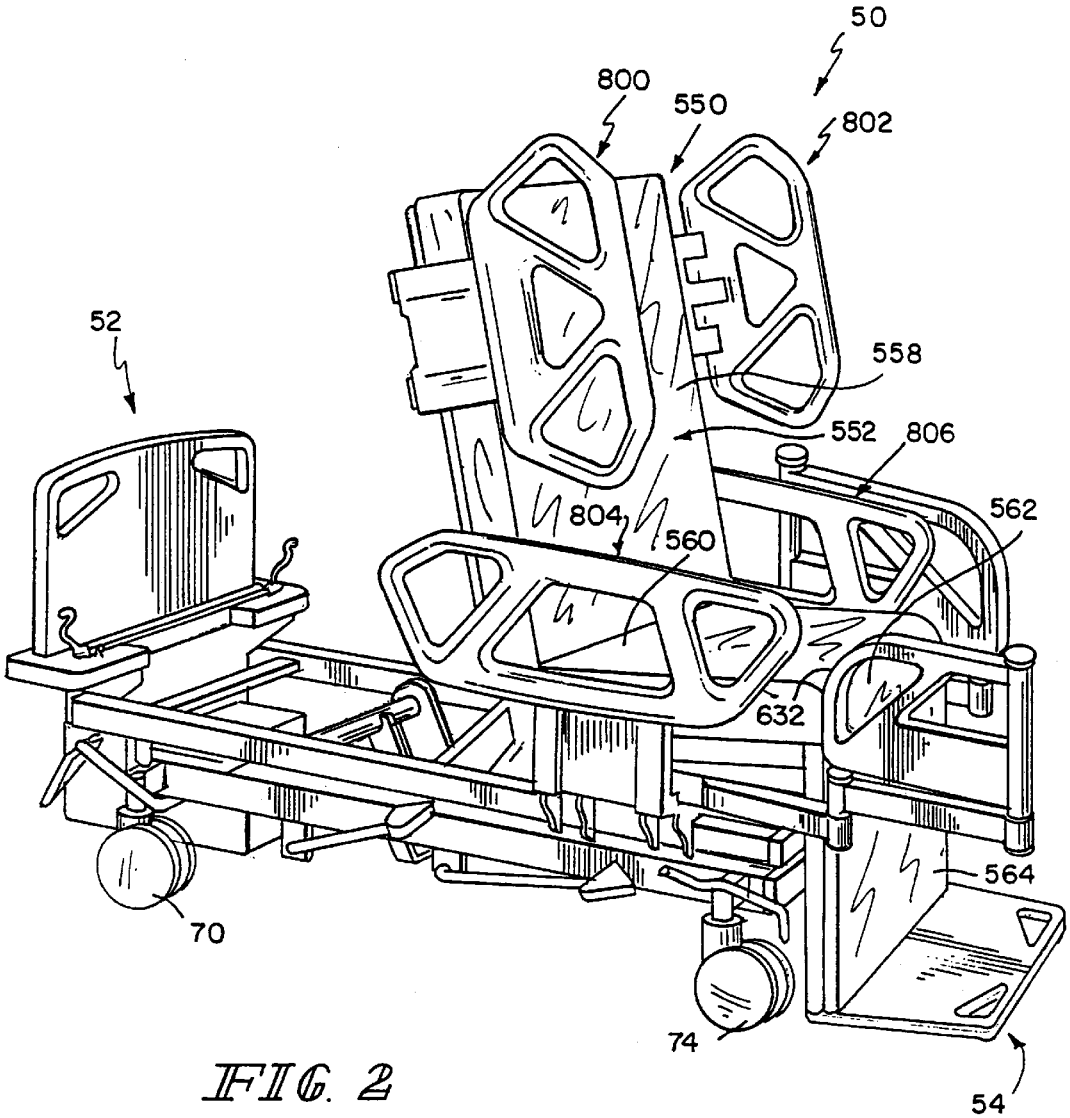
FIG. 2 is a view similar to FIG. 1 showing the chair bed in the sitting or chair position having a head section of an articulating deck moved upwardly to a back-support position, a thigh section of the deck inclined slightly upwardly, a foot section of the deck moved to a generally vertical downwardly extending down position, a foot portion of the mattress being deflated, and swinging gates moved to an open position with one swinging gate folded next to the chair bed.
Figure 8:
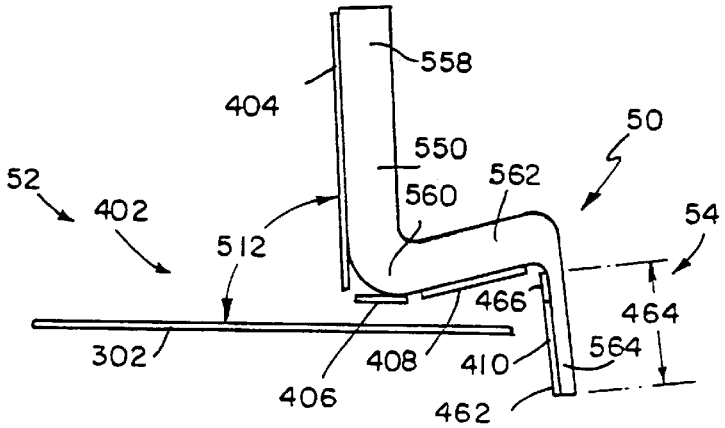
FIG. 8 is a diagrammatic view showing the chair bed in the chair position with the head end of the head section pivoted upwardly away from the seat section to a back-support position, the seat section lying generally horizontal as in the initial deck position, the thigh section being raised upwardly, the foot section extending downwardly from the thigh section and being a second shorter length, and the portion of the mattress over the foot section being deflated.

As described above, chair bed 50 is convertible to a sitting or chair position shown in FIG. 2 and shown diagrammatically in FIG. 8. In the chair position, head end 52 of head section 404 of deck 402 is pivoted upwardly away from intermediate frame 302 to a back-support position providing a pivotable backrest so that head section 404 and intermediate frame 302 form an angle 512 generally between 55 and 90 degrees.

Seat section 406 of deck 402 is positioned to lie generally horizontally as in the initial position, foot end 54 of thigh section 408 is slightly upwardly inclined, and foot section 410 of deck 402 extends generally vertically downwardly from thigh section 408 and has a length 464 that is shorter length 465 than when deck 402 is in the initial position. Foot portion 564 of mattress 550 is inflatable and is in a deflated condition when chair bed 50 is in the chair position. Foot portion 564 of mattress 550 is thinner and shorter when deflated than when inflated.

Chair bed 50 is capable of assuming positions in which head, thigh, and foot sections 404, 408, 410 of deck 402 are in positions intermediate to those shown in FIGS. 3 and 8. For example, chair bed 50 can assume an intermediate position shown diagrammatically in FIG. 7 having head end 52 of head section 404 of deck 402 pivoted slightly upwardly from the initial position, seat section 406 positioned to lie in the same generally horizontal plane as in the initial position, foot end 54 of thigh section 408 raised slightly upwardly from the initial position, and foot section 410 being inclined so that foot end 54 of foot section 410 lies below head end 52 of foot section 410.

The electrical system architecture of the hospital bed of the present invention includes a plurality of electronically controlled modules located on the bed which are interconnected in a peer-to-peer configuration. This peer-to-peer communication network configuration enables any of the plurality of modules to communicate directly with another module in the network without the need for a master controller. In the preferred embodiment, information flow between the electronic modules is primarily accomplished through the use of a twisted pair network channel, although other physical protocols would be acceptable.

Details of the mechanical structure of the bed, the electronic control modules, and the peer-to-peer communication network of the present invention are described in copending U.S. patent application Ser. No. 08/511,711, filed Aug. 4, 1995, the disclosure of which is hereby expressly incorporated by reference into the present application.

Figure 9:
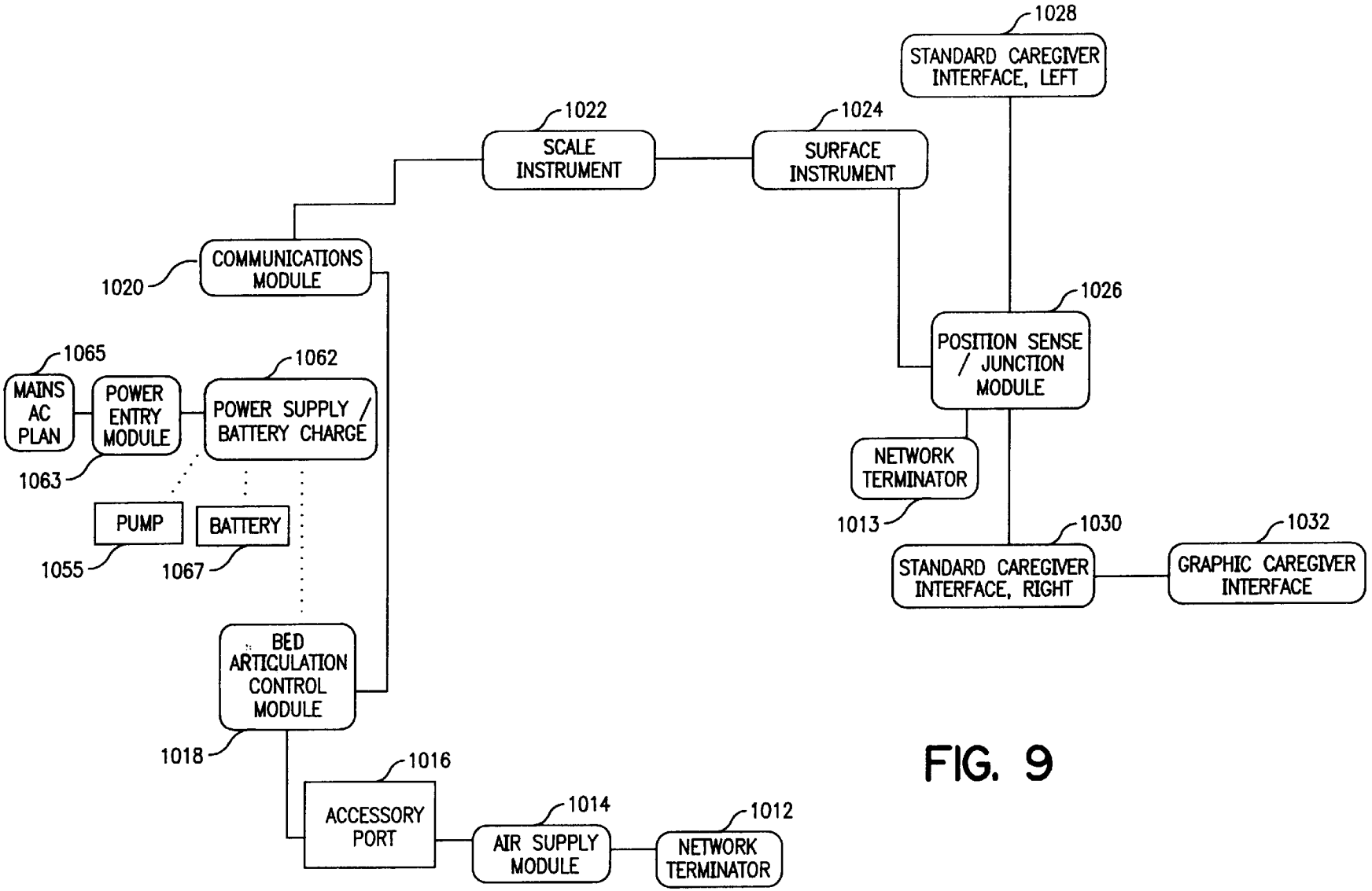
FIG. 9 is a block diagram illustrating a plurality of electronic control modules of the present invention connected in a peer-to-peer network configuration.

FIG. 9 is a block diagram illustrating the plurality of electronic control modules for controlling operation of the hospital bed. The plurality of modules are coupled to each other using a twisted pair network channel in a peer-to-peer configuration. The peer-to-peer network extends between first and second network terminators 1012 and 1013. Network terminator 1012 is coupled to an air supply module 1014. Air supply module is coupled via the network cable to an accessory port module 1016. Accessory port module 1016 is coupled to the bed articulation control module (BACM) 1018. BACM 1018 is coupled to a communications module 1020.

Communications module is coupled to a scale instrument module 1022. Scale instrument module is coupled to a surface instrument control module 1024. Surface instrument control module is coupled to a position sense and junction module 1026. Position sense module 1026 is coupled to the network terminator 1013. A left side standard caregiver interface module 1028 is also coupled to the network by a tee connection in the position sense module 1026. The right side standard caregiver interface module 1030 and a graphic caregiver interface module 1032 are also coupled to the network using the tee connector in the position sense module 1026.

It is understood that the modules can be rearranged into a different position with the peer-to-peer communication network. The modules are configured to communicate with each other over the network cable without the requirement of a master controller. Therefore, modules can be added or removed from the network without the requirement of reprogramming or redesigning a master controller. The network automatically recognizes when a new module is added to the network and automatically enables a control interface such as the graphic caregiver interface module 1032 to display specific module controls for the added module. This eliminates the requirement for separate controls on the individual modules.

Power for the communication network is supplied by a power supply and battery charge module 1062. Power supply 1062 is coupled to a power entry module 1063 which is coupled to an AC main plug 1065. Power supply module 1062 converts the AC input from plug 1065 to DC levels to be used by the electronic modules. The power supply module 1062 also provides power for limited bed functionality upon removal of the AC main power plug 1065 through a battery 1067. The power supply module 1062 contains an automatic battery charging circuit with an output to indicate battery status. The power module 1062 also control a hydraulic pump 1055.

Figure 10:
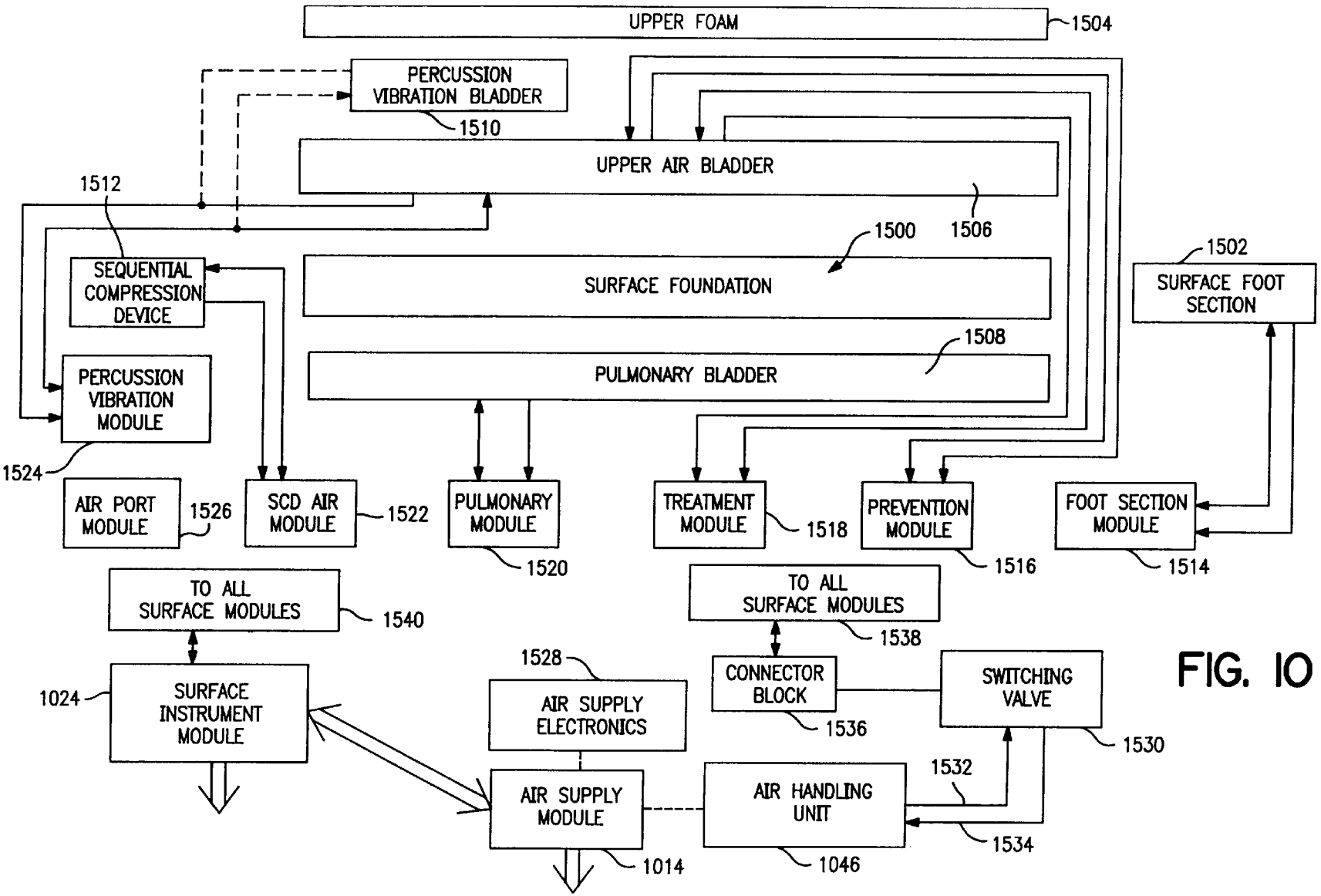
FIG. 10 is a block diagram illustrating the modular therapy and support surface system of the present invention including a plurality of control modules for controlling various air therapy devices and surface sections of a support surface and illustrating an air supply module for controlling an air handling unit and a switching valve to selectively supply air pressure and a vacuum to the various therapy devices and surface sections.

Details of the modular therapy and support surface apparatus of the present invention are illustrated in FIG. 10. The support surface of the present invention is configured to be positioned over a bed deck 402 of a hospital bed. The support surface includes a surface foundation 1500 located on the bed deck. An inflatable and deflatable surface foot section 1502 is located adjacent surface foundation 1500. For certain applications, an upper foam support surface 1504 is located on foundation 1500. Upper foam support 1504 is typically used for short hospital stays. An upper air bladder 1506 can also be positioned over surface foundation 1500. A rotation bladder 1508 is located between the surface foundation and the bed deck. An optional percussion bladder 1510 may be inserted in place of a section of upper air bladder 1506. A sequential compression device 1512 for venous compression therapy of a patient is also provided.

A plurality of separate treatment and surface control modules are provided for interconnecting the various treatment devices and support surface bladders to the communication network of the bed and to on-board air handling unit 1046. Specifically, the present invention includes a foot section control module 1014, a decubitus prevention control module 1516, and a decubitus treatment control module 1518. The modular therapy apparatus further includes a pulmonary rotation control module 1520, a sequential compression device air control module 1522, and a pulmonary percussion and vibration control module 1524. An auxiliary air port control module 1526 is also provided. The air port control module 1526 provides for auxiliary air output for manual filling of auxiliary bladder systems for positioning, safety barriers, clinical treatments such as burn contractures, and other purposes.

Each of the modules is designed to physically and functionally connect the various bladders and treatment devices to both the communication network of the hospital bed through the surface instrument module 1024 and to the air handling unit 1046 which is controlled by air supply module 1014. Air supply module 1014 is coupled to the peer-to-peer communication network. Air supply electronics 1528 are connected to air supply module 1014 for controlling air handling unit 1046 and switching valve 1530 based on network commands for controlling the various surface and treatment modules illustrated in FIG. 10.

Air handling unit 1046 is configured to supply air under pressure to switching valve 1530 on line 1532. Air handling unit 1046 also applies a vacuum to switching valve 1530 through line 1534. An output of switching valve 1530 is coupled to a connector block 1536. Connector block 1536 provides an air and vacuum supply line to each of the surface control and treatment control modules as illustrated in block 1538 of FIG. 10. It is understood that dual control lines for both air and vacuum can be supplied to each of the surface control and treatment control modules of FIG. 10. This dual control allows each module to apply pressure and vacuum simultaneously to different zones of a bladder or treatment device.

The surface instrument module 1024 which is also coupled to the peer-to-peer communication network is electrically coupled to each of the surface control modules and treatment control modules as illustrated in block 1540 of FIG. 10. This network connection permits all the modules to receive input commands from other network modules and to output information to the network.

Figure 11:
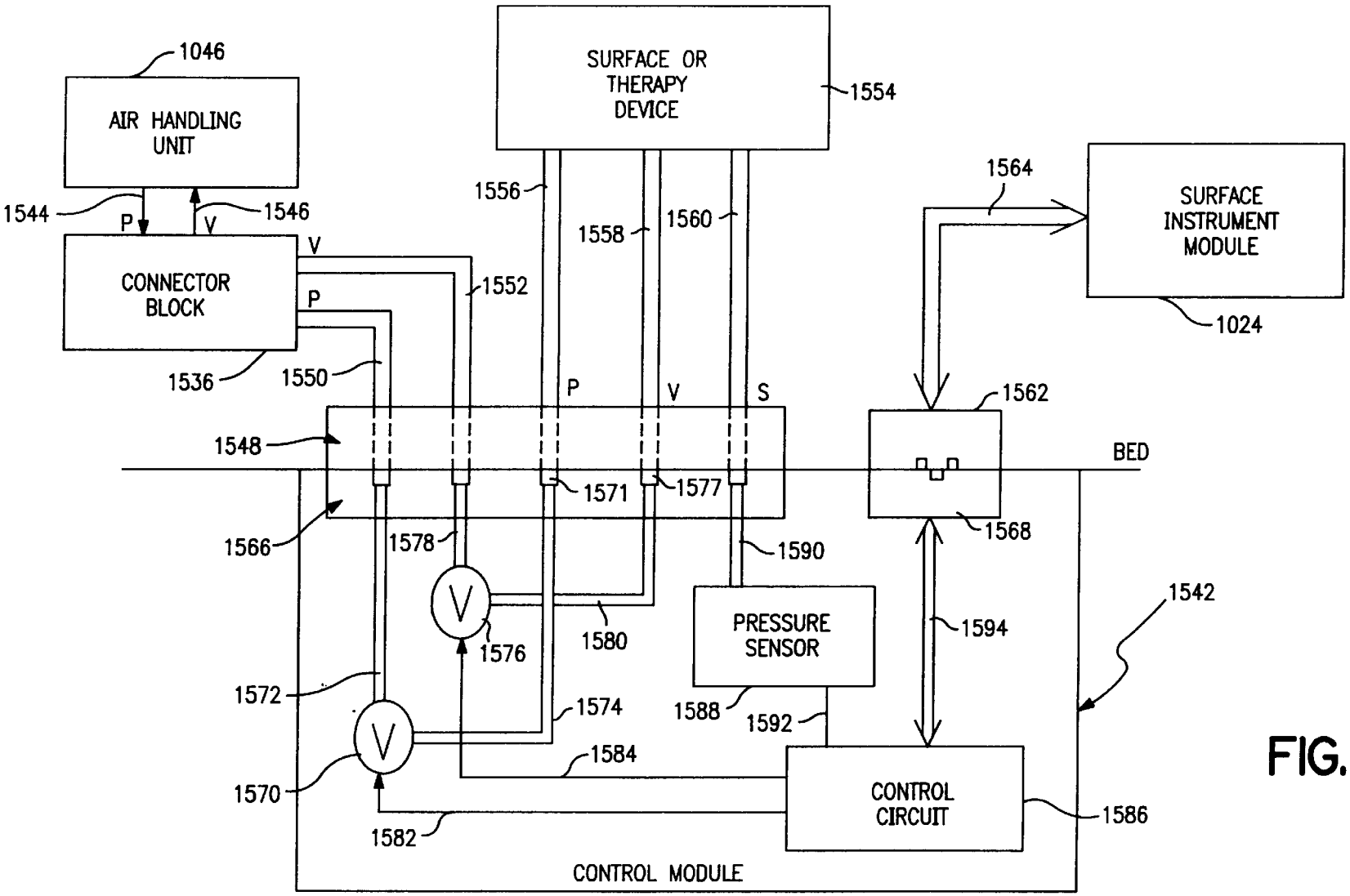
FIG. 11 is a diagrammatical illustration of the configuration of an air therapy control module.

Details of a therapy or support surface control module 1542 are illustrated in FIG. 11. It is understood that the details of foot section module 1514, prevention module 1516, treatment module 1518, pulmonary rotation module 1520, SCD air module 1522, pulmonary percussion/vibration module 1524, and air port module 1526 include the same or similar structural components as module 1542 illustrated in FIG. 11. The FIG. 11 embodiment illustrates the air handling unit 1046 coupled directly to connector block 1536 by both an air pressure supply line 1544 and a vacuum supply line 1546. As discussed above, lines 1549 and 1546 from air handling unit may be coupled to a switching valve 1530 and only a single pressure/vacuum tube may be coupled to connector block 1536 as illustrated in FIG. 10.

The connector block 1536 is coupled to module connector 1548 located on the hospital bed. Specifically, connector block 1536 is coupled to module connector 1548 by a pressure supply line 1550 and a vacuum supply line 1552. It is understood that a single supply line for both pressure and vacuum could also be used.

Module connector 1548 is also coupled to one of the surface or therapy devices as illustrated by a block 1554 by a pressure supply line 1556, a vacuum supply line 1558, and a sensor supply line 1560. Depending upon the particular surface or therapy device, more than one pressure, vacuum, and sensor lines may be connected between the connector block 1548 and the surface or therapy device 1554. Typically, each separate air zone of the surface or therapy device will have its own pressure, vacuum, and sensor lines. For illustration purposes, however, only a single set of supply lines will be discussed.

The bed also includes an electrical connector 1562 coupled to surface instrument module 1024 of the peer-to-peer communication network of the bed by suitable cable 1564. The therapy or surface control module 1542 illustrated in FIG. 11 is designed to facilitate coupling of the control module 1542 to the bed. Each of the surface and treatment options illustrated in FIG. 10 is provided in the bed with a pneumatic connector such as connector 1548 and an electrical connector such as connector 1562 provided for each of the surface and therapy devices. The module 1542 is easily installed by coupling connector 1548 on the bed to a mating connector 1566 of module 1542. In addition, a mating electrical connector 1568 is provided on module 1542 for coupling to electrical connector 1562 on the hospital bed. The configuration of module 1542 permits a simple "slide in" connection to be used to install the module 1542 and activate the surface of therapy device 1554.

An air pressure input from pneumatic connector 1566 is coupled to an electrically controlled valve 1570 by a supply line 1572. An output of valve 1570 is coupled to a pressure output port 1571 by line 1574. Port 1571 is coupled to the surface or therapy device 1554 by pressure supply line 1556.

The vacuum supply line 1552 from connector block 1536 is coupled to an electrically controlled valve 1576 by line 1578 of control module 1542. An output of valve 1576 is coupled to a vacuum port 1577 of connector 1566 by line 1580. Vacuum port 1577 is coupled to the surface or therapy device 1554 by the vacuum supply line 1558. The electrically controlled valves 1570 and 1576 are controlled by output signals on lines 1582 and 1584, respectively, from a control circuit 1586 of module 1542. Control circuit includes a microprocessor or other controller for selectively opening and closing valves 1570 and 1576 to control surface or treatment device 1554.

It is understood that several valves may be used for each surface or treatment device. For instance, the upper air bladder 1506 may have a plurality of different air zones which are independently controlled. In this instance, separate pressure and vacuum and sensor lines are coupled to each zone of the air bladder. An electrically controlled valve is provided for each pressure and sensor line in each zone to provide independent controls for each zone.

Module 1542 also includes a pressure sensor 1588. Pressure sensor 1588 is coupled to sensor supply line 1560 by line 1590. Pressure sensor 1588 generates an output signal indicative of the pressure in the particular zone of the surface or therapy device 1554. This output signal from pressure sensor 1588 is coupled to the control circuit 1586 by line 1592.

Control circuit 1586 is also coupled to an electrical connector 1568 by a uitable connection 1594 to couple the control circuit 1586 of module 1542 to the surface instrument module 1024. Therefore, control circuit 1586 can receive instructions from the other modules coupled to the peer-to-peer communications network illustrated in FIG. 9. Control circuit 1586 can also output information related to the particular surface or therapy device 1554 to the network. Specifically, the graphical interactive display 1664 or the graphic caregiver interface module 1032 is coupled to the electrical communication network for transmitting command signals for the plurality of air therapy devices over the electrical communication network to control operation of the plurality of air therapy devices. The graphical interactive display includes a display and a user input. Each control module transmits display commands to the display related to the corresponding air therapy device. The display commands from the control modules provide a menu driven list of options to the display to permit selection of control options for the plurality of air therapy devices from the user input.

Figure 12:
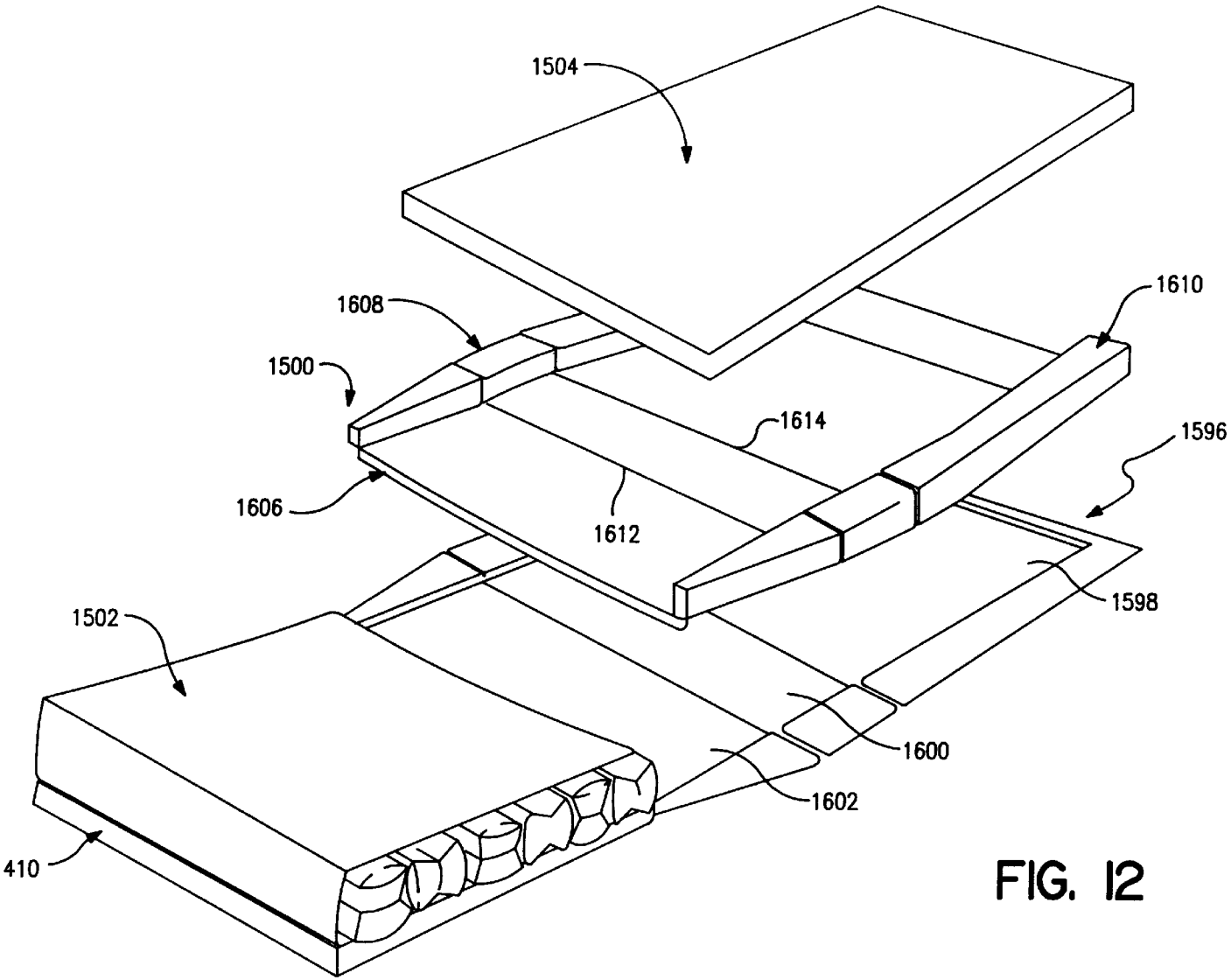
FIG. 12 is an exploded perspective view illustrating a foam surface foundation with side bolsters configured to be positioned on a deck of the bed, an upper foam support surface, and an inflatable and deflatable surface foot section.
Figure 13:
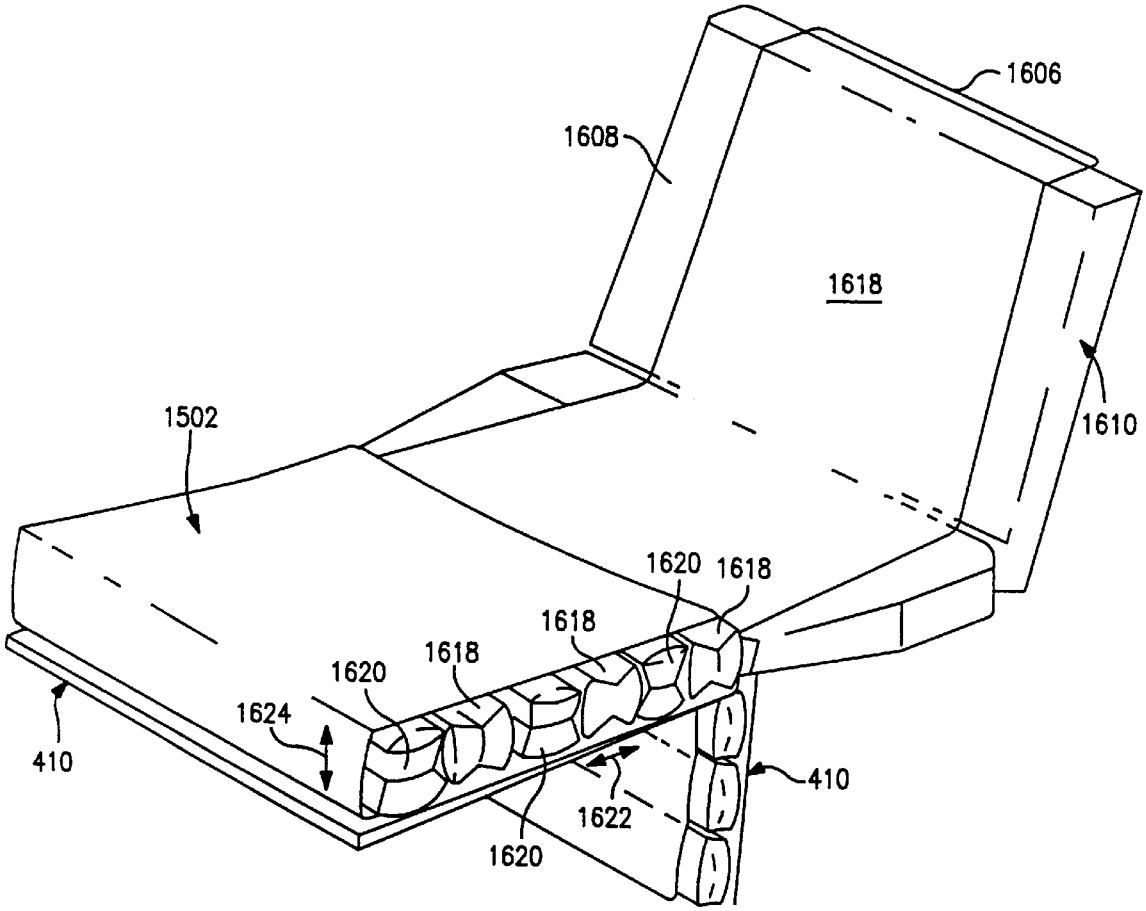
FIG. 13 is a perspective view illustrating the surface foot section in an inflated configuration when the bed is in a normal bed position and illustrating the surface foot section in a retracted and collapsed configuration when the bed is in a chair position.

Details of the structural features of the modular therapy and support surface are illustrated in FIGS. 12–21. FIG. 12 illustrates a deck portion 1596 of a hospital bed. Illustratively, deck portion 1596 is a step deck having a cross-sectional shape best illustrated in FIGS. 18–20. Illustratively, deck 1596 includes a head section 1598, a seat section 1600, and a thigh section 1602. Sections 1598, 1600, and 1602 are all articulatable relative to each other.

The modular therapy and support surface system of the present invention includes surface foundation 1500 including a foundation base 1606 and side bolsters 1608 and 1610. Preferably, side bolsters 1608 and 1610 are coupled to opposite sides of foundation base 1606. Foundation base 1606 includes foldable sections 1612 and 1614 to permit the foundation 1500 to move when the step deck 1596 articulates.

The hospital bed also includes an expanding and retracting foot section 410 to facilitate movement of the hospital bed to the chair position. Surface foot section 1502 is located over the retracting mechanical foot portion 410. Surface foot section 1502 is described in detail below with reference to FIGS. 13–16.

The FIG. 12 embodiment includes an upper foam surface insert 1504 configured to the positioned on the foam foundation base 1606 between side bolsters 1608 and 1610. Foam surface 1504 provides a suitable support surface for a patient who is mobile and whose length of stay is expected to be less than about two days.

The surface foot section 1502 is particularly designed for use with the chair bed of the present invention. The foot section 1502 includes a first set of air bladders 1618 and a second set of air bladders 1620 alternately positioned with air bladders 1618. Air bladders 1618 and 1620 are configured to collapse to a near zero dimension when air is withdrawn from the bladders 1618 and 1620. The first set of bladders 1618 are oriented to collapse in a first direction which is generally parallel to the foot section 410 of the bed deck as illustrated by double headed arrow 1622. The second set of bladders 1620 are configured to collapse in a second direction generally perpendicular to the foot deck section 410 as illustrated by double headed arrow 1624. This orientation of bladders 1618 and 1620 in foot section 1502 causes the foot section 1502 to retract or shorten and to collapses or thin as the bladders 1618 and 1620 are deflated by the foot section control module 1514 as the hospital bed moves from a bed orientation to a chair orientation. In the chair orientation, the foot deck section 410 and surface foot section 1502 move from a generally horizontal position to a generally vertical, downwardly extending position. Preferably, the foot deck section 410 moves from a retracted position to an extended position to shorten the foot deck section as the articulating deck of the bed moves to a chair configuration. Movement of the foot deck section 410 is controlled either by a cylinder coupled to the contracting portion 462 of the foot deck section 410, or by an air bellows controlled by a bellows control module coupled to the air handling unit 1046 and the air supply module 1014.

The minimizing foot section 1504 is further illustrated in FIG. 14. The surface foot section 1502 deflates as it moves from the bed position to the chair position in the direction of arrow 1626. In the bed position, the surface foot section 1502 has a length of about 27 inches (68.6 cm) and a thickness of about 5 inches (12.7 cm) when the bladders 1618 and 1620 are fully inflated. When in the downwardly extended chair position illustrated at location 1628 in FIG. 14, the surface foot section is fully deflated and has a length of about 14 inches (35.6 cm) and a thickness of preferably less than one inch (2.54 cm). The length of the surface foot section is preferably reduced by at least 40% and the thickness of the surface foot section is preferably reduced by at least 80% as the bed moves to the chair configuration. The width of the surface foot section 1502 remains substantially the same in both the bed orientation and the chair orientation.

Pressure control in the surface foot section 1502 is illustrated diagrammatically in FIG. 15. Each of the vertically collapsible bladders 1620 are separately coupled to foot section control module 1514 by pressure/vacuum supply lines 1630 and sensor lines 1632. Therefore, each of the three bladders 1620 are independently coupled to and controlled by foot section control module 1514. Each of the three horizontally collapsing bladders 1618 are commonly connected to a common pressure/vacuum source of the foot section control module as illustrated line 1634. A single sensor line 1636 is used to determine the pressure in the common zone of the interconnected bladders 1618. The control configuration illustrated in FIG. 15 permits independent inflation and deflation of bladders 1620 to provide heel pressure relief in foot section 1502. Details of the heel pressure management apparatus are illustrated in U.S. Pat. No. 5,666,681, owned by the assignee of the present application, the disclosure of which is hereby expressly incorporated by reference into the present applications.

Another embodiment of the foot section 1502 is illustrated in FIG. 16. In this embodiment, bladders 1618 have been replaced by diamond shaped bladders 1640. It is understood that any shape which collapses in a specified direction upon deflation may be used in foot section 1502 of the present invention to provide the shortening or retracting and thinning or collapsing features discussed above.

Figure 17:
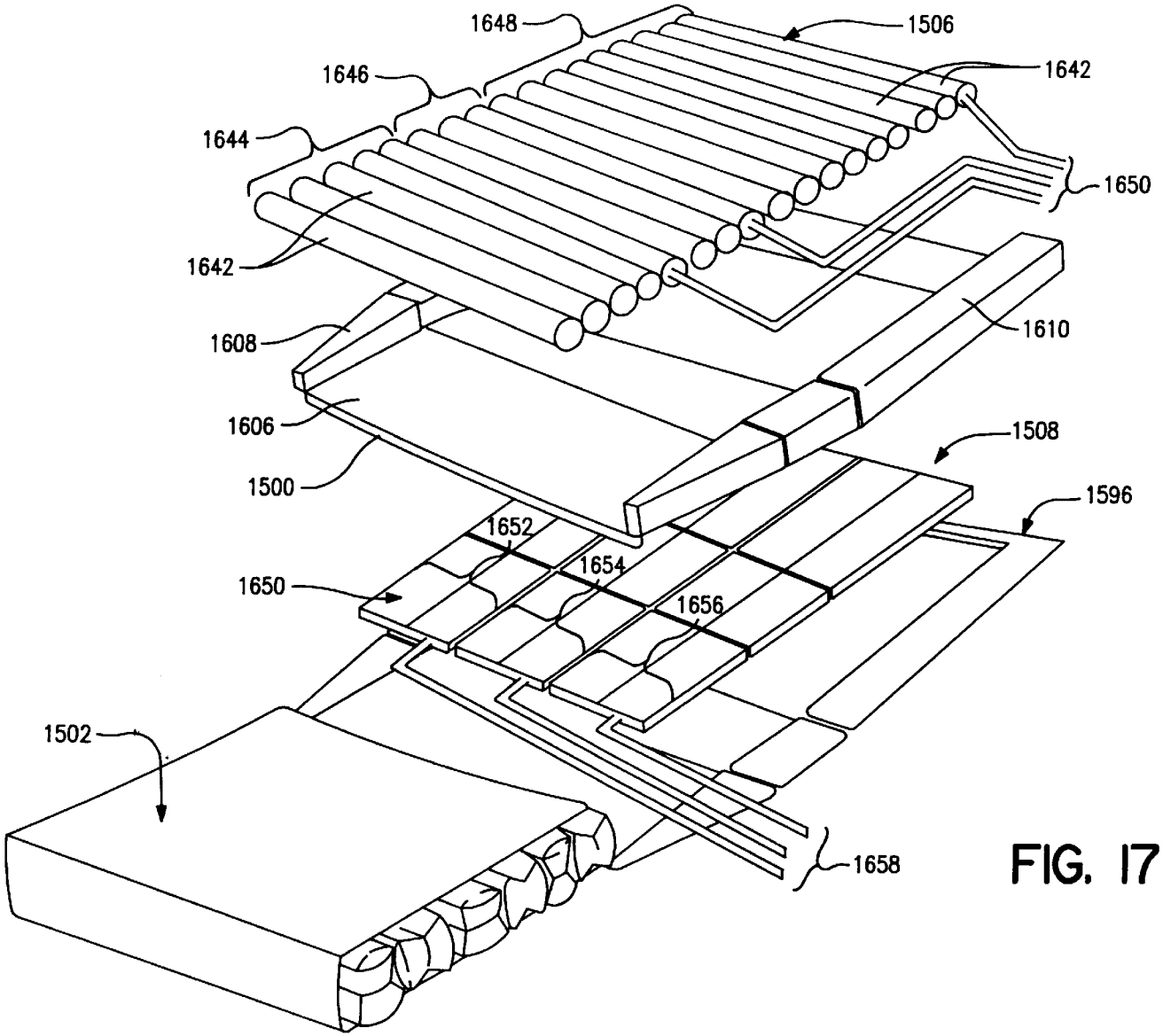
FIG. 17 is an exploded perspective view of another embodiment of the present invention illustrating a pulmonary therapy rotational bladder located between a deck of the bed and the surface foundation and illustrating an upper air bladder support surface located above the surface foundation in place of the upper foam support surface of FIG. 10.

Additional surface and treatment options of the modular air therapy and support surface apparatus are illustrated in FIG. 17. In FIG. 17, an upper air bladder 1506 is located on foam foundation base 1606 between side bolsters 1608 and 1610. Upper air bladder 1506 includes a plurality of adjacent air tubes or bladders 1642 oriented transverse to a longitudinal axis of the bed. Illustratively, bladders 1642 are connected in three commonly controlled zones 1644, 1646, and 1648. It is understood that more zones may be provided. If desired, each bladder 1642 may be controlled independently.

The surface instrument module 1024 receives commands from the BACM 1018 and the position sense module 1026 to reduce the pressure in a seat section defined by zone 1644 of the upper air bladder 1506 as the bed moves to the chair configuration in order to distribute a patient's weight. A thigh section of the deck is angled upwardly to help maintain the patient in a proper position on the seat when the bed is in the chair configuration.

For the upper surface decubitus prevention, the three supply tubes 1650 of upper air bladder 1506 are all connected to a common pressure source through prevention module 1516. For the upper surface decubitus treatment, the three supply lines 1650 are coupled to three separate valves in treatment module 1518 to control each of the zones 1644, 1646, and 1648 of upper air bladder 1506 independently.

A pulmonary rotation bladder 1508 is located between foundation base 1606 and step deck 1596. It is understood that rotation bladder 1508 may be positioned between foundation base 1606 and upper air bladder 1506 if desired. Rotation bladder 1508 includes separate bladders 1650 which are oriented to run parallel to a longitudinal axis of the hospital bed. Illustratively, three separate pressure zones 1652, 1654, and 1656 are provided in rotation bladder 1508. In the illustrated embodiment, each of the pressure zones 1652, 1654, and 1656 are independently controlled by pressure supply lines 1658. Each pressure supply line is coupled to a separate valve in pulmonary control module 1520 illustrated in FIG. 10. A separate sensor line (not shown) for each zone 1652, 1654, and 1656 is also coupled to pulmonary rotation control module 1520.

Figure 18:
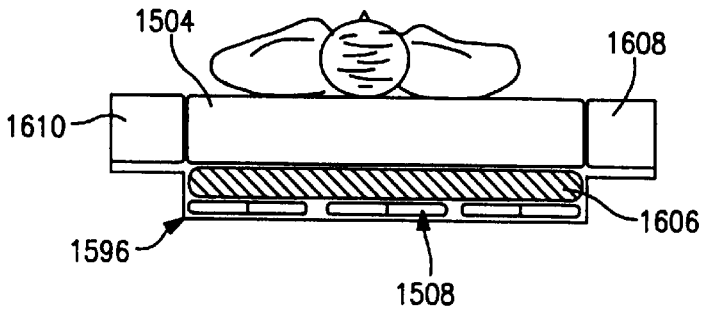
FIG. 18 is a diagrammatical end view illustrating the configuration of the modular therapy and support surface of the present invention when the pulmonary bladders are all deflated.

Pulmonary rotation bladder 1508 is stored in a deflated position within the bed until it is desired to treat the patient with rotational therapy. In this embodiment, the rotation bladder 1508 does not provide a support surface for the patient. The support surface is provided by either upper foam mattress 1504 or upper air bladder 1506. Therefore, rotation bladder 1508 can be stored flat in the bed during normal operation of the bed as illustrated in FIG. 18. It is understood that in another embodiment of the invention, the rotation bladder 1508 may be normally inflated to provide a support surface for the patient.

When it is desired to provide rotational treatment to the patient, a pulmonary rotation control module 1520 is coupled to the bed. The graphical interactive display 1664 of the bed or the graphic caregiver interface module 1032 automatically recognizes that the pulmonary rotation control module 1520 is attached to the bed. Therefore, controls for the pulmonary rotation therapy device can be actuated from the graphical interactive display 1664 or the graphic caregiver interface 1032.

FIG. 18 illustrates the configuration of rotation bladder 1508 in its deflated position during normal operation of the bed with the upper foam mattress 1504 in place of upper air bladder 1506. In FIG. 18, all three zones 1652, 1654, and 1656 of rotation bladder 1508 are deflated or flat.

Figure 19:
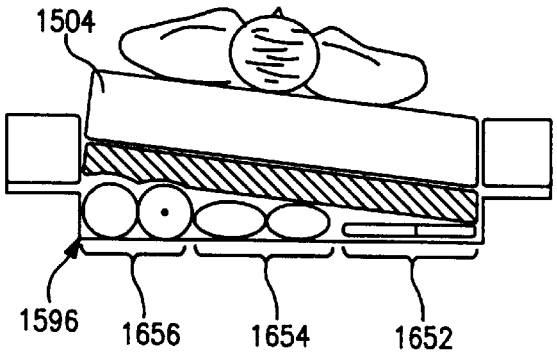
FIG. 19 is a diagrammatical view similar to FIG. 15 illustrating inflation of left side pulmonary bladders to rotate a patient to the right.
Figure 20:
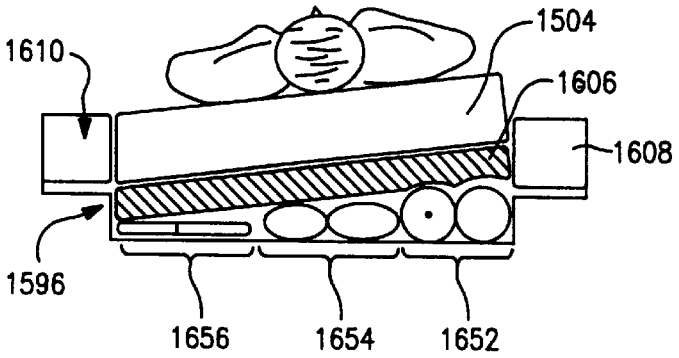
FIG. 20 is a diagrammatical view similar to FIGS. 15 and 16 illustrating inflation of the right side pulmonary bladders to rotate the patient to the left.

FIG. 19 illustrates actuation of the rotation bladder 1508 to rotate a patient situated on foam mattress 1504 to the right. Pulmonary rotation control module 1520 controls airflow to fully inflate zone 1656 to partially inflate zone 1654, and to deflate zone 1652 of rotation bladder 1508. FIG. 20 illustrates actuation of the rotation bladder 1508 to rotate the patient to the left. Pulmonary rotation control module 1520 fully inflates zone 1652, partially inflates zone 1656, and deflates zone 1654 to rotate the patient.

Figure 21:
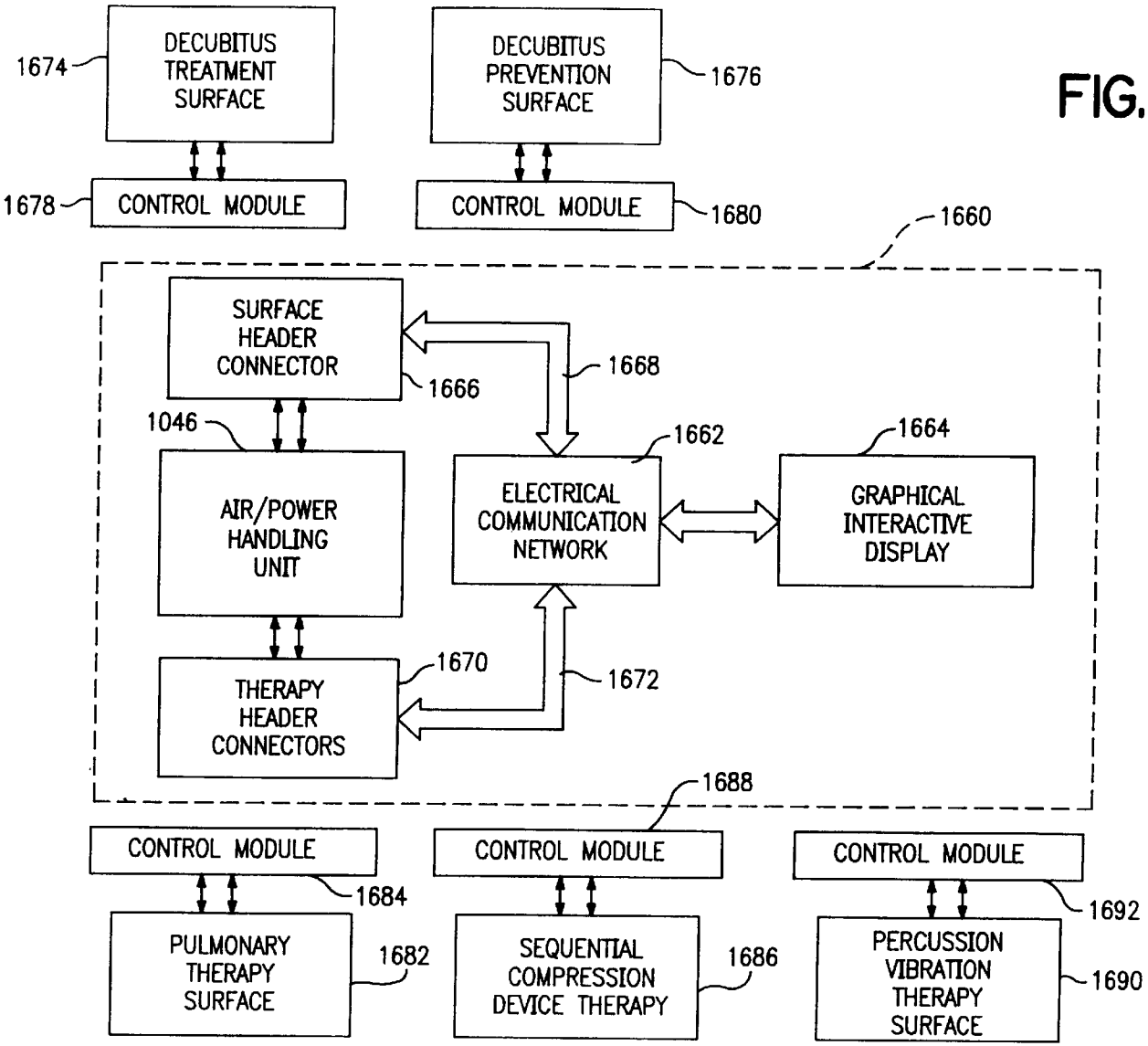
FIG. 21 is a block diagram illustrating another embodiment of the present invention illustrating separate exchangeable surfaces or therapy devices which are each coupled to a control module including pneumatic control valves and sensors, an electrical connection, and a processor for communicating with an air and power handling unit on the bed and with a graphical interface display on the bed through the electrical communication network of the bed.

Another embodiment of the modular therapy and support surface invention is illustrated in FIG. 21. In this embodiment, separate exchangeable surfaces are provided. The bed is illustrated by dotted line 1660. As discussed above, the bed includes a peer-to-peer communication network 1662 which is coupled to a graphical interactive display 1664. It is understood that graphical interactive display 1664 may be the graphic caregiver interface module 1032 discussed above. In addition, graphical interface display 1664 may be a display with control switches embedded in a foot board or at another location of the bed to provide a user control for all therapy and surface options. As discussed above, the network 1662 automatically recognizes when a specific therapy module is connected to the bed 1660 and automatically provides control options to the graphical interactive display 1664. The open architecture of the electrical communication network 1662 allows interaction between the added module and the graphical interactive display 1664 without redesigning the system. Bed 1660 includes a surface header connector 1664 coupled to the air handling unit 1046 and to the electrical communication network 1662 by line 1668. In addition, bed 1660 includes therapy header connectors illustrated at block 1670 which are connected to the air and power handling unit 1046 and to the electrical communication network 1662 as illustrated by line 1672.

In this embodiment of the present invention, separate surfaces are provided, including a decubitus treatment surface 1674 and a separate decubitus prevention surface 1676. The decubitus treatment surface 1674 has its own attached control module 1678 for connecting to surface header 1666. Decubitus prevention surface 1676 has its own control module 1680 configured to be coupled to surface header connector 1666. Header connector 1666 is connected to modules 1678 or 1680 in a manner similar to module 1542 in FIG. 11.

Separate therapy modules are also provided. A pulmonary rotation therapy surface 1682 can be added to bed 1660. Rotation therapy surface 1682 is coupled to its own control module 1684 which is configured to be connected to therapy header connector 1670. A sequential compression therapy device 1686 is also provided.

Sequential compression device 1686 is coupled to its own control module 1688 which is configured to be connected to therapy header connector 1670. The present invention permits the sequential compression device to use an on board air handling unit 1046 and control system. This eliminates the requirement for a separate air pump and control panel which takes up valuable floor space near the bed and makes the bed difficult to move.

A separate pulmonary percussion and vibration therapy surface 1690 is also provided. Pulmonary percussion and vibration therapy surface 1690 is added to bed 1660 in place of a portion of the support surface of the bed. Pulmonary percussion and vibration therapy surface 1690 is coupled to its own control module 1692. Control module 1692 is configured to be coupled to a therapy header connector 1670.

The separate control modules are used to control power and air distribution, and to control user options displayed on the graphical interactive display 1664 for each therapy or surface option. As discussed above in detail with reference to FIG. 11, each control module 1678, 1680, 1684, 1688 and 1692 contain valves, sensors, and electronic control circuits specific to the particular surface or therapy application. All control features are implemented as a menu driven interactive control for the selected therapy or surface module of the present invention on the graphical interface display 1664 or on the graphic care giver interface 1023.

All surface related parameters can be transmitted from surface instrument module 1024 to communications module 1020 and then to a remote location via the hospital network. Surface instrument 1024 can be interrogated by a diagnostic tool coupled to accessory port 1016 if desired. Information related to the surface modules can also be received via modem from a remote location through accessory port 1016.

Figure 22:
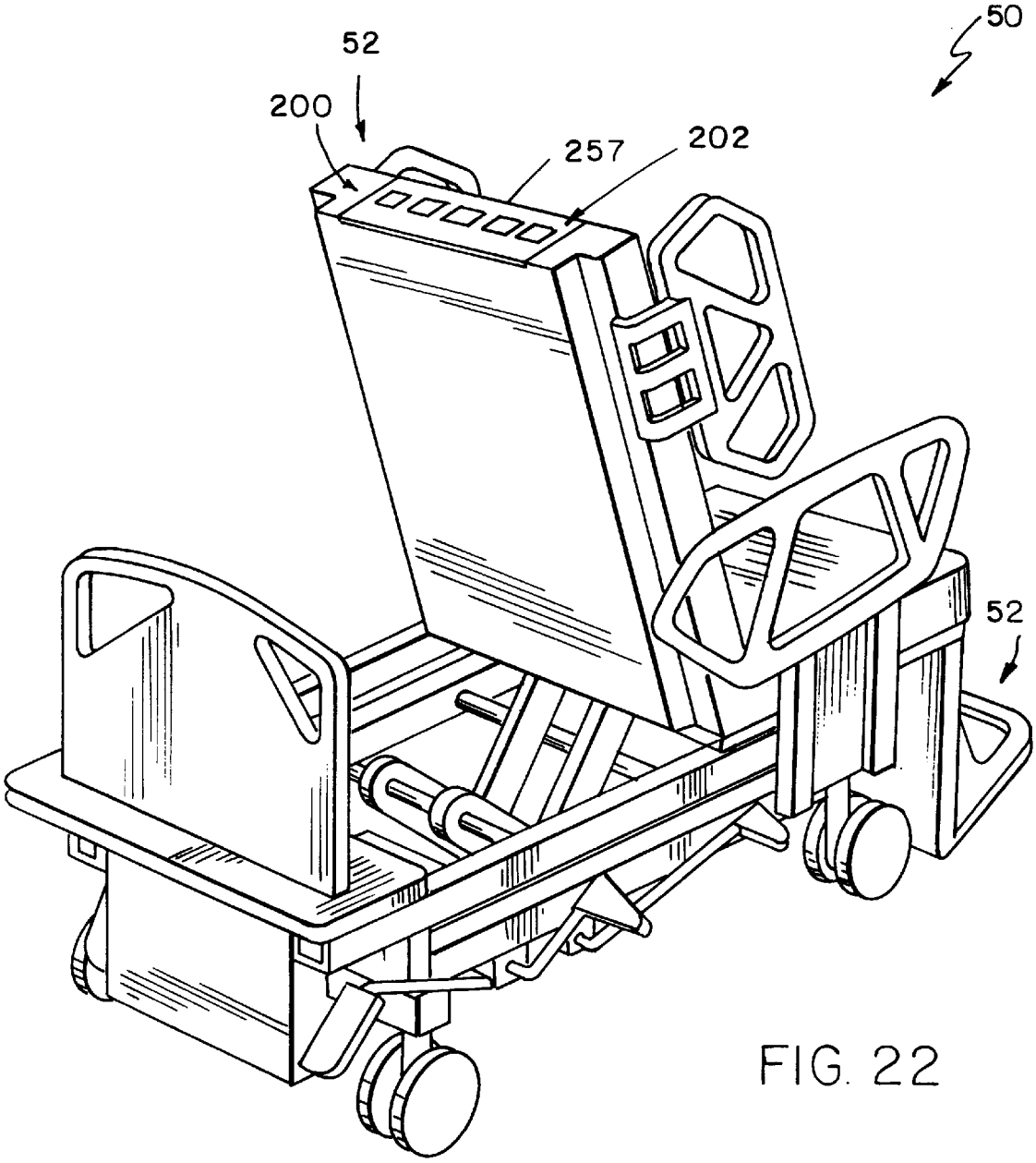
FIG. 22 is a perspective view of the head end of the hospital bed illustrating a manifold configured to receive a plurality of control modules for the plurality of air therapy and support surfaces on the bed.
Figure 23:
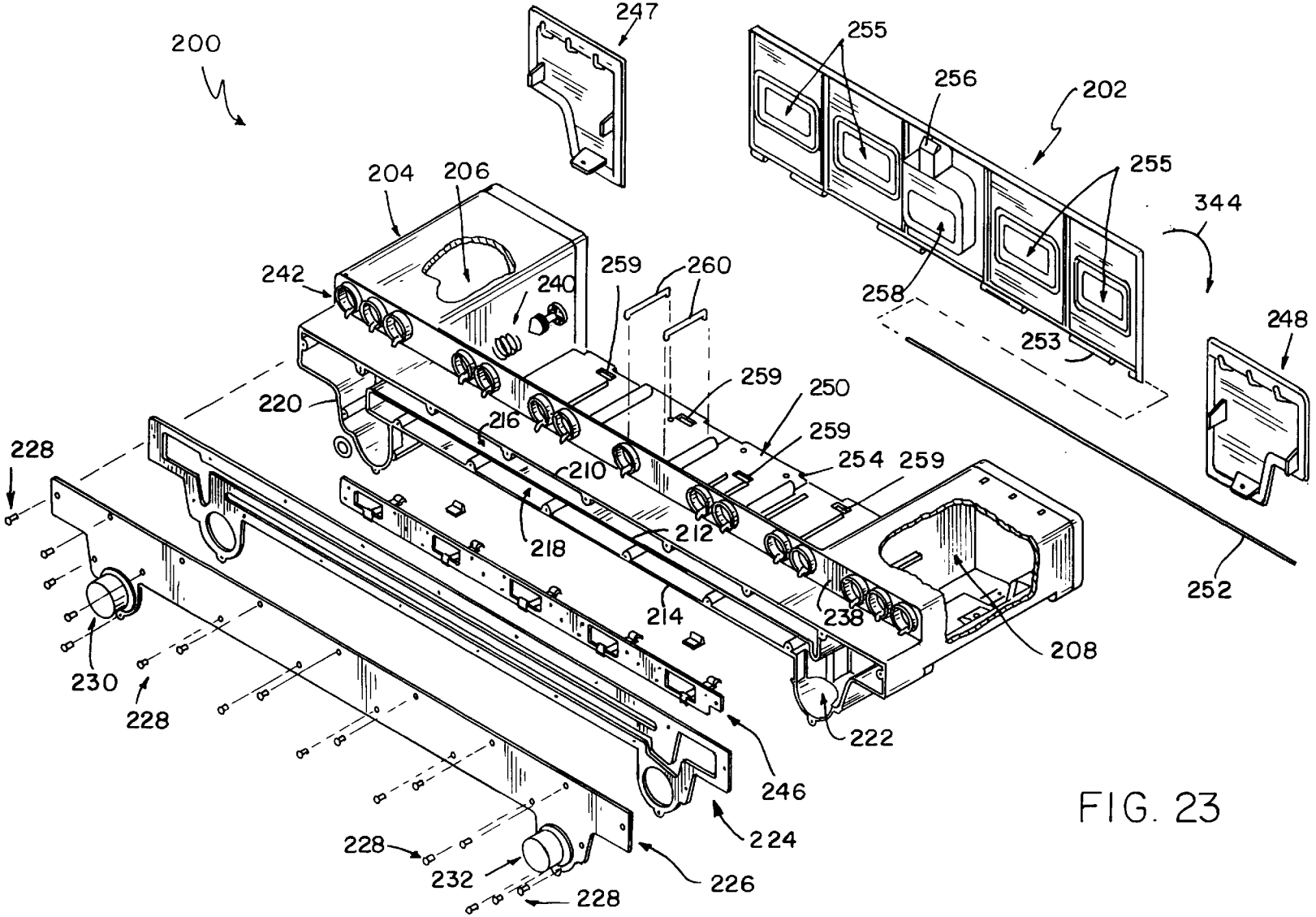
FIG. 23 is an exploded perspective view of the control module receiving manifold of the present invention.

FIG. 22 further illustrates the bed 50 of the present invention which includes a manifold assembly 200 coupled to the head end 52 of bed 50. The manifold 200 includes an access door 202 to permit removable control modules 203 to be loaded into the manifold 200 as discussed in detail below. Details of the manifold assembly 200 are illustrated in FIG. 23. Manifold 200 includes a manifold body portion 204 configured to receive a plurality of control modules 203 to control the various therapy devices and support surfaces on the bed as discussed above. The body portion 204 includes module receiving recesses 206 and 208 located opposite ends of the body portion 204. Body portion 204 also includes a spaced apart walls 210, 212, and 214 which define a first chamber 216 and a second chamber 218 therebetween. First chamber 216 is in communication with a first open end region 220 of body portion 204. Second chamber 218 is in communication with a second open end region 222. First end region 220 and first chamber 216 are isolated from second end region 222 and second chamber 218.

Chambers 216 and 218 and open regions 220 and 222 are sealed by a gasket 224 and an outer cover 226 which is configured to be secured to manifold body portion 204 with suitable fasteners 228. Cover 226 includes a first inlet 230 in communication with the first open end region 220, and a second inlet 232 in communication with the second open end region 222 of manifold body 204. Inlet 230 is configured to be coupled to an air pressure supply line 1544 from air handling unit 1046. (See FIG. 11.) Inlet 232 is configured to be coupled to a vacuum supply line 1546 from air handling unit 1046. Therefore, pressure is supplied to end region 220 and chamber 216 of manifold body 204. Vacuum is supplied to end region 222 and chamber 218 of manifold body 204.

Figure 24:
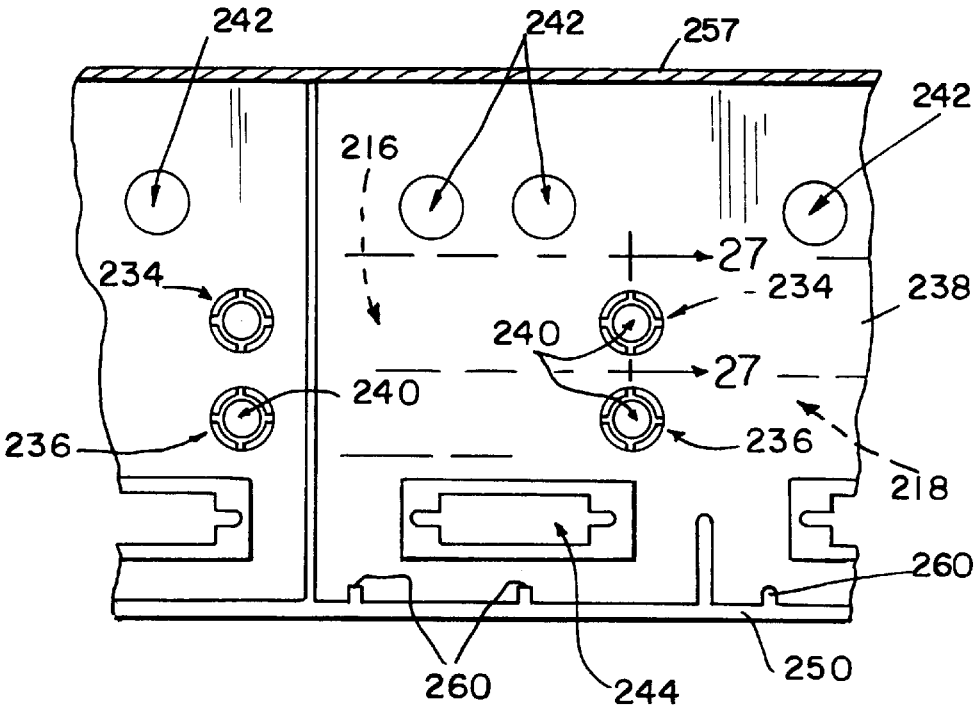
FIG. 24 is a plan view illustrating an interior surface of the manifold configured to receive the control module.

A wall 238 of the manifold body 204 is formed to include a plurality of pairs of outlet apertures 234 and 236. The apertures 234 and 236 are in communication with chambers 216 and 218, respectively, as shown in FIG. 24. A separate pair of outlet apertures 234 and 236 are provided for each module receiving portion of the manifold 200. Five separate pairs of outlet apertures 234 and 236 are included in the illustrated embodiment. Therefore, five separate removable modules 203 can be selectively coupled to the manifold 200 at different locations. It is understood that the manifold may be formed to receive a different number of modules 203.

A normally closed valve 240 is located within each aperture 234 and 236 as discussed below. Apertures 234 and 236 are configured to provide pressure and vacuum supplies to the control modules 203 illustrated in FIG. 25 as discussed below.

Manifold body 204 further includes a plurality of apertures 242 which are configured to receive connectors 310 which are coupled to various support surface and therapy devices on the bed 50. Manifold 200 further includes an electrical connector 244 coupled to the electrical communication network on bed 50. A connector grounding plate 246 is coupled to manifold body 204.

End plates 247 and 248 are configured to be coupled to front openings of regions 206 and 206, respectively. Treatment module 1518 is configured to be located within first region 206, and prevention module 1516 is configured to be located within the second region 208. The treatment module 1518 and prevention module 1516 are permanently installed within manifold 200. Two inputs 234 and 236 and three outputs 242 are provided in regions 206 and 208 for the treatment module 1518 and prevention module 1516.

Manifold body 204 includes a bottom surface 250 configured to receive the removable control modules 203 of the present invention. A rod 252 is slidably inserted into openings 253 and 254 formed in the door 202 and bottom surface 250, respectively, so that door 202 is pivotably coupled to the bottom support surface 250. Opposite ends of the rod 252 abut end plates 247 and 248 to maintain the rod 252 on the manifold body 204. The door 202 includes access windows 255 and a center latch 256 configured to engage an opening (not shown) adjacent top surface 257 illustrated in FIG. 22. An actuator (not shown) in recessed portion 258 allows an operator to release the latch 256 to provide access to the module receiving surface 250 of manifold 200.

Bottom surface 250 is illustratively configured to receive five separate control modules 203. Surface 250 includes apertures 259 which receive a locking member 270 to lock the modules 203 in place as discussed below. In addition, surface 250 includes spaced apart indexing ribs 260. The ribs 260 are configured to cooperate with slots 262 formed in a bottom surface 263 of the modules 203 to prevent a module 203 from being inserted into the wrong location on surface 250. The indexing ribs 260 only allow an appropriate control module 203 with properly positioned slots 262 to be installed at a particular location. Since output apertures 242 are already connected to predetermined therapy and support surfaces on the bed, each different control module 203 has a predetermined location on the surface 250 of manifold 200.

In addition to the indexing ribs 260 which cooperate with slots 262, each of the five separate module receiving portions on surface 250 are illustratively color coded with a different color. The color coding may be on door 202 surrounding windows 255. The appropriate module 203 is also coded with the same color to provide a visual indication to the caregiver of the proper location for each module 203 within manifold 200. Labels indicating the module type or a module number may also be used as indicators.

Figure 25:
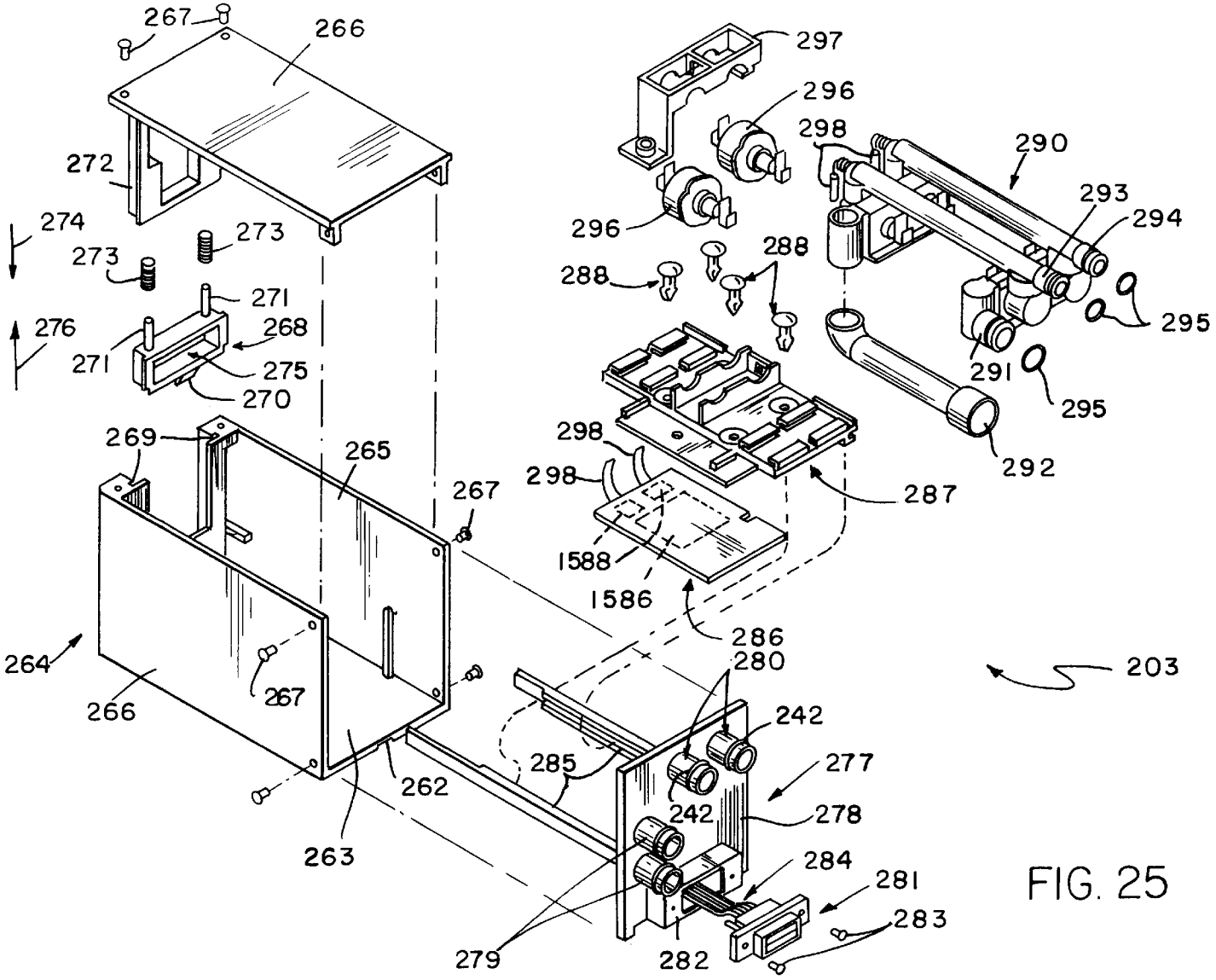
FIG. 25 is an exploded perspective view of one of the removable control modules configured to be inserted into the manifold.

Details of the control module 203 are illustrated in FIG. 25. The control module 203 includes an enclosure 264 having bottom surface 263 formed to include the keying slots 262 that cooperate with indexing ribs 260. Enclosure 264 also includes opposite side portions 265 and 266. A top 266 is configured to be coupled to side portions 265 and 266 by fasteners 267.

A latch 268 is slidably received within slots 269 of enclosure 264. Latch 268 includes a locking member 270 configured to enter an opening 259 of bottom surface 250 as the module is inserted into the manifold body portion 204 to secure the module 203 to the manifold 200. Latch 268 further includes posts 271 which slide into apertures (not shown) formed in front surface 272. Springs 273 are configured to bias the latch 268 downwardly in the direction of arrow 274 to hold the locking member 270 within the aperture 259. Latch 268 includes a center open portion 275 to permit an operator to grab the latch 268 and lift upwardly in the direction of arrow 276 to release the locking member 270 from the aperture 259 and remove the module 203 from the manifold 200. Front surface 272 is illustratively coded with a color, number, and/or a label to match the coding on the manifold 200 as discussed above.

Enclosure 264 further includes a module frame 277 having an end wall 278 formed to include a first pair of cylindrical apertures 279 and a second pair of cylindrical apertures 280. O-ring seals 242 are coupled to annular grooves on an outer surface of the cylindrical apertures 279 and 280 to provide seals. An electrical connector 281 is coupled to an extended portion 282 of end wall 278 by fasteners 283. Wires 284 extend from connector 281 and are coupled to a control circuit 1586 on printed circuit board 286.

A pair of support arms 285 extend inwardly from end wall 278. The printed circuit board 286 and a valve mounting plate 287 are located within the enclosure 264. Four standoffs 288 are provided. Control module 203 also includes a valve assembly 290 having inlets 291 and 292 and outlets 293 and 294. O-ring seals 295 are located on end portions of inlet 291 and outlets 293 and 294. Inlet 291 slides into cylindrical apertures 279 and is sealed by O-ring 295. Inlet 292 is a molded rubber tube which connects to a flange (not shown) on the inside of end wall 278 in communication with the lower aperture 279. Outlets 293 and 294 slide into cylindrical apertures 280 and are sealed by O-rings 295.

The valve assembly 290 includes a pair of stepper motors 296 for controlling operation of valves at opposite ends of the valve assembly 290. Valve assembly 290 is configured to receive fluid pressure from manifold outlet aperture 234 through inlet 291 and vacuum from manifold outlet aperture 236 through inlet 292. The valve assembly 290 selectively controls flow of pressure and vacuum to both the valve outlets 293 and 294. The stepper motors 296 control the pressure supplied from the valves to the outlets 293 and 294 based upon outputs received from the control circuit 1586. Motors 296 are held in position by retainer 297. Sensor tubes 298 are coupled to both the outlet tubes 293 and 294. The sensor tubes 298 are coupled to pressure sensors 1588 on printed circuit board 286. Therefore, in the embodiment of the present invention, both pressure and vacuum can be supplied to either of the outlet tubes 293 and 294. Sensor tubes 298 provide pressure readings within the tubes 293 and 294. Therefore, a single output line to the therapy device or surface on the bed can be used to supply pressure, vacuum, and take sensor readings of the particular zone of the therapy device or surface.

Figure 26:
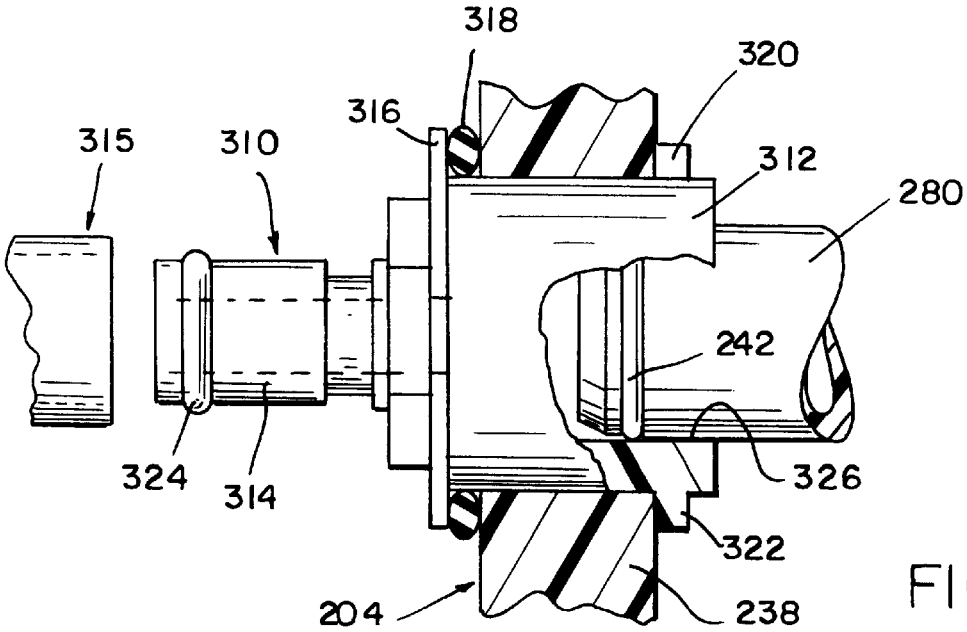
FIG. 26 is a sectional view illustrating an outlet connector coupled to a wall of the manifold to couple the inserted control module to a selected air zone of a therapy device or support surface.

FIG. 26 illustrates a connector 310 for coupling outlet apertures 280 of the control module 203 to various therapy and support zones on the bed 50. The outlet connector body 310 includes a first cylindrical portion 312 configured to be inserted through apertures 242 in wall 238 of manifold 200, and a smaller diameter cylindrical portion 314 for connection to a therapy device or support surface zone by supply tube 315. Connector 310 includes a flange 316 and an O-ring 318 located adjacent flange 316. A pair of opposing bosses 320 and 322 are formed on cylindrical portion 312 spaced apart from flange 316. The bosses 320 and 322 provide a bayonet-type fastener for securing the connector 310 to the wall 238 of manifold body portion 204. When the connector 310 is secured to the wall 238 as illustrated in FIG. 26, the O-ring 318 is compressed to provide a spring between the connector 310 and the wall 238 to hold the bayonet bosses 320 and 322 tight against the wall 238. A second O-ring seal 324 is located within an arcuate groove formed in second cylindrical portion 314. This O-ring seal 324 provides a seal with an inner diameter of the supply tube 315 when the tube 315 is connected to the cylindrical body portion 316 of connector 310.

When the control module 203 is inserted into the manifold 200, the outlets 280 of the control module 203 automatically enter open ends 326 of connectors 310 as shown in FIG. 26. O-rings 242 provide a seal against inner wall 326. Therefore, pressure or vacuum flows through outlets 293 and 294 of the valve assembly 290, to the connectors 310, and then to the selected therapy device or support surface zone coupled to connector 310 by tubes 315.

Figure 27:
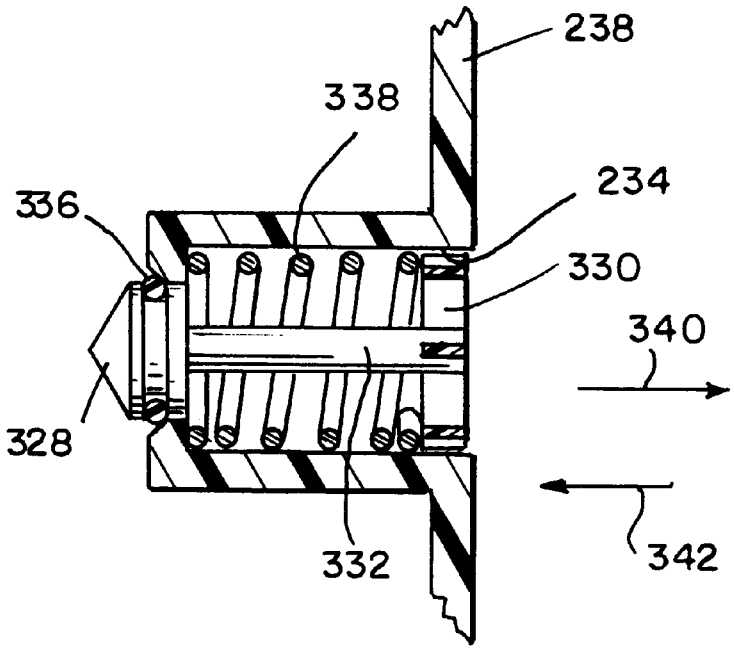
FIG. 27 is a sectional view taken along lines 27—27 of FIG. 24 illustrating details of a normally closed valve coupled to an outlet aperture of the manifold.
Figure 28:
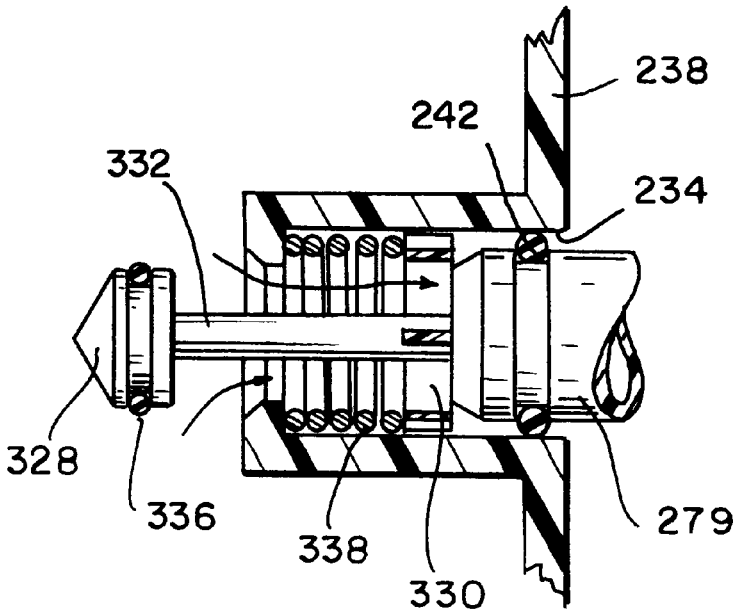
FIG. 28 is a sectional view similar to FIG. 27 illustrating an inlet portion of the control module inserted into the outlet aperture of the manifold to open the normally closed valve and permit flow of pressure from the air handling unit into the control module.
Figure 29:
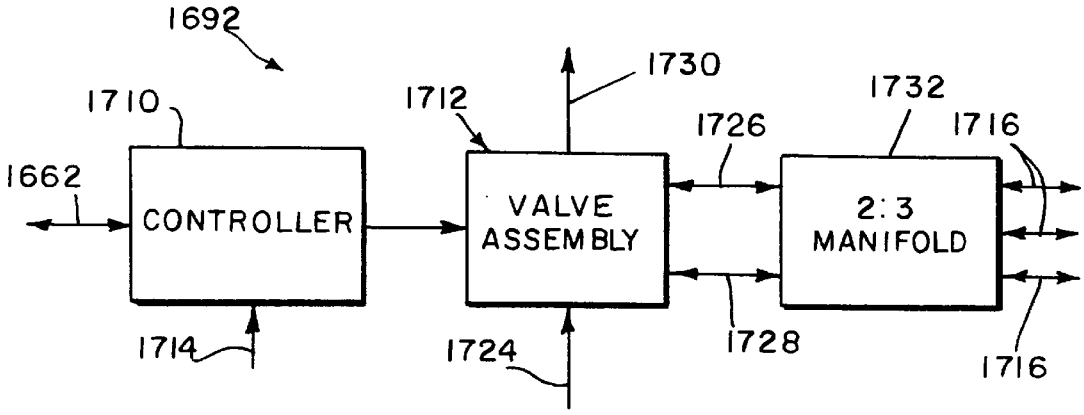
FIG. 29 is a block diagram illustrating a percussion and vibration therapy module including a valve assembly and an electronic controller, the module coupled to an electronic communication network, to an air pressure supply, and to a 2:3 manifold that in turn is coupled to three percussion and vibration bladders.
Figure 30:
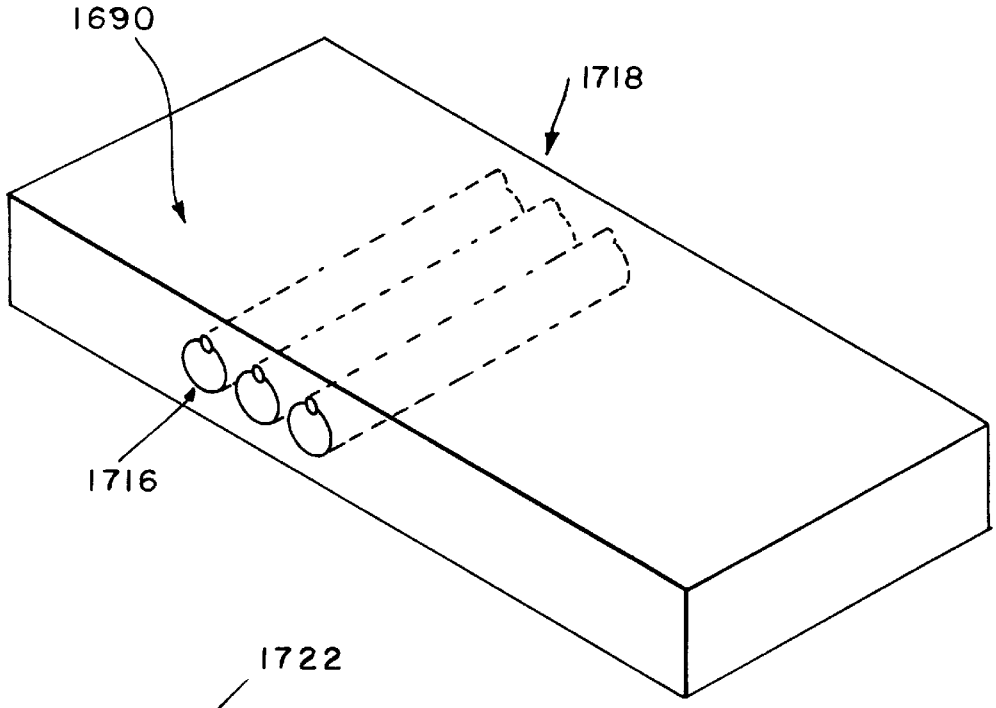
FIG. 30 is a perspective diagrammatic view illustrating a mattress including three laterally extending percussion and vibration bladders within a back section of the mattress for use with the percussion and vibration therapy module of FIG. 29.

The normally closed valve 240 for sealing apertures 234 and 236 are illustrated in FIGS. 27 and 28. The valve 240 include a plunger having a head 328, a foot 330, and a shaft 332 formed integrally with the head 328 and foot 330. The head 328 is formed to include an annular groove 334 for receiving an O-ring seal 336. A spring 338 is configured to engage the foot 330 and bias the valve 240 in the direction of arrow 340.

During installation, the head 328 is inserted through a selected aperture 334 or 336 and into the chamber 216 or 218, respectively, against the force of spring 338. The O-ring 336 is then installed in the annular groove 334 of head 328. When the valve 240 is released, the spring 338 biases the foot 330 in the direction of arrow 340 until the O-ring 336 engages the wall 238 within the manifold chamber 216 or 218. This provides a normally closed valve 240 for sealing the chambers 216 and 218 when control modules 203 are not located within the manifold 200. When a module 203 is inserted, the inlets 279 automatically enter apertures 236 and 234, respectively, and engage the foot 330 to move the valve 240 in the direction of arrow 342. This causes movement of the head 328 to the position shown in FIG. 28 to open the valve 240 and permit pressure or vacuum to be supplied to the inlets 291 and 292 of valve assembly 290 through apertures 234 and 236.

In operation, the bed is configured to include desired therapy and support devices that are coupled to the selected connectors 310 on manifold 200. When not in use, chambers 216 and 218 are sealed by normally closed valves 240. When it is desired to install a particular type of control module 203 to control a therapy or support device on the bed, the door 202 is opened by releasing latch 256 and pivoting the door 202 downwardly in the direction of arrow 344 in FIG. 23. The desired module 203 is marked with a selected color, number, and/or label which corresponds to the same module indicator on door 202 and/or on the surface 250. The coding identifies the precise location within the manifold 200 for the selected control module 203. Index ribs 260 on surface 250 cooperate with slots 262 formed on bottom surface 263 of the module enclosure 264 to prevent a module 203 from being inserted into the wrong area of manifold 200. Since the indexing ribs 260 have different sizes and spacing for each module 203, a module 203 cannot be inserted into the improper location within manifold 200. As the module is installed into the manifold 200, inlets 279 automatically enter apertures 234 and 236, respectively, and open normally closed valves 240 as discussed above. This supplies both pressure and vacuum to the valve assembly 290 of the control module 203. Outlets 280 of module 203 enter the apertures 326 of connectors 310 to connect the outlets 293 and 294 of valve assembly 290 to the selected therapy and surface zones on the bed 50. Electrical connector 281 also makes electrical connection to connector 244 on manifold 200 to provide an electrical connection between the electrical communication network of the bed 50 and the control circuit 1586 of the control module. Locking member 270 snaps into recess 259 on surface 250 when the module 203 is fully inserted. The communication network of the bed automatically recognizes that a module 203 has been connected to the electrical network and provides an option on the graphic caregiver interface 1032 for performing the specific therapy controlled by the installed module 203. The module 203 can be removed by moving latch 268 upwardly to release locking member 270. The valves 240 automatically close chambers 216 and 218 when the module is removed.

Referring now to FIGS. 29–33, percussion and vibration control module 1692 includes a controller 1710 and a valve assembly 1712. Controller 1710 is coupled to communication network 1662, which, as discussed above is coupled to graphical interactive display 1664. Controller 1710 is further provided with electrical power input 1714 that provides operating voltages as needed within module 1692, such as 15 Volts DC for solenoid operation and 8 Volts DC for controller circuit operation.

Figure 31:
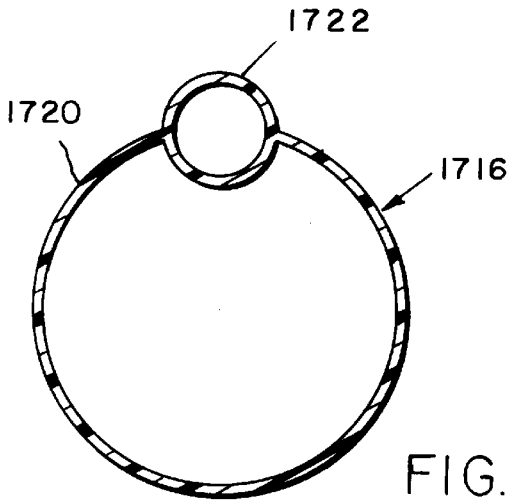
FIG. 31 is a cross section of a laterally extending percussion and vibration bladder of FIG. 30 showing a support chamber and a percussion chamber.
Figure 32:
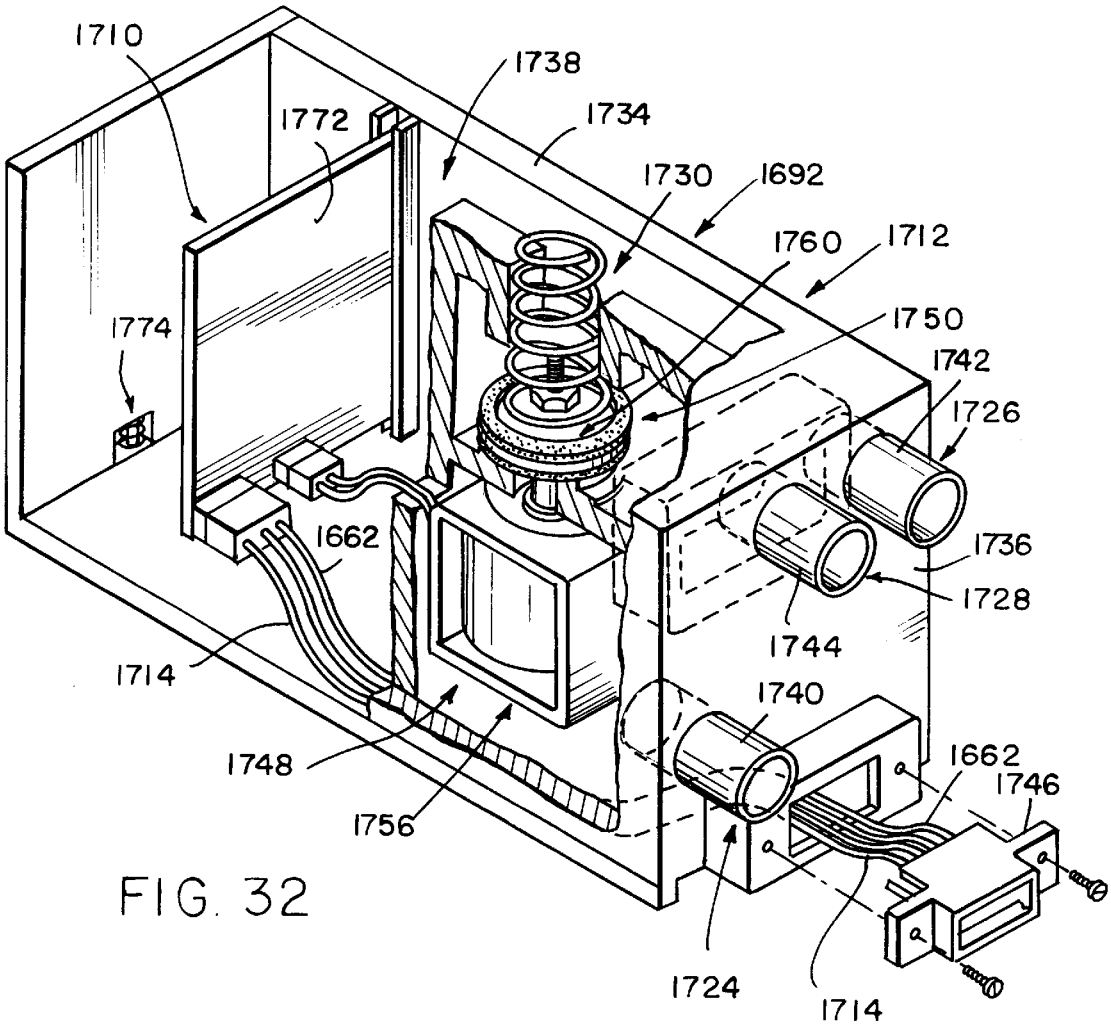
FIG. 32 is a perspective view of an embodiment of the percussion and vibration therapy module of FIG. 29 including a pressurized air port, two percussion and vibration bladder ports, an electronic control and power connector, and a housing with portions cut away to show a controller circuit board and a valve assembly having a pressure chamber, a bladder chamber, a solenoid, and a spring-biased valve.

As discussed above, percussion and vibration control module 1692 is coupled to vibration therapy surface 1690. Vibration therapy surface 1690 illustratively includes three laterally extending percussion and vibration bladders 1716 in a back region 1718 as shown diagrammatically in FIG. 30. Bladders 1716 include a support tube 1720 and a percussion tube 1722 as best shown in FIG. 31. The dual-tube design of bladder 1716 provides for supporting a patient while administering percussion and vibration therapy according to known techniques. Support tube 1720 typically maintains a constant pressure while module 1692 percusses the patient by cycling pressurized air into and out of percussion tube 1722 at desired frequencies, for example between 1 Hz and 25 Hz. The present invention contemplates any percussion rate. In addition, module 1692 is capable of providing percussion and vibration for any type of bladder configuration. Valve assembly 1712 includes a pressurized air input port 1724, a pair of percussion and vibration bladder ports 1726, 1728, and a pair of exhaust ports 1730. The two bladder ports 1726, 1728 are coupled to the three bladders 1716 in surface 1690 via a two-to-three manifold 1732. Controller 1710 accomplishes a desired percussion and vibration therapy by selectively coupling pressurized air into percussion tube 1722 from input port 1724 to bladder ports 1726, 1728 through valve assembly 1712 as discussed in more detail below. Although shown with two bladder ports coupled to three bladders through a two-to-three manifold, other arrangements of ports and bladders can be used by providing a suitable manifold, Percussion and vibration control module 1692 includes a housing 1734 with an outside surface 1736 and an interior chamber 1738. Pressurized air input port 1724 includes a tube 1740 extending from the outside surface 1736 of the housing 1734. Percussion and vibration bladder ports 1726, 1728 similarly include tubes 1742, 1744 extending from housing 1734. An electrical connector 1746 provides for coupling external power and communication signals to controller 1710.

Valve assembly 1712 is formed with a pressure chamber 1748 that is in fluid communication with pressurized air input port 1724 and a bladder chamber 1750 in fluid communication with bladder ports 1726, 1728. An opening 1752 between pressure chamber 1748 and bladder chamber, 1750 provides a path for pressurized air to reach bladder ports 1726, 1728, and an exhaust opening 1754 that communicates with exhaust ports 1730 provides an exhaust path for air from bladder ports 1726, 1728 to the environment.

Figure 33:
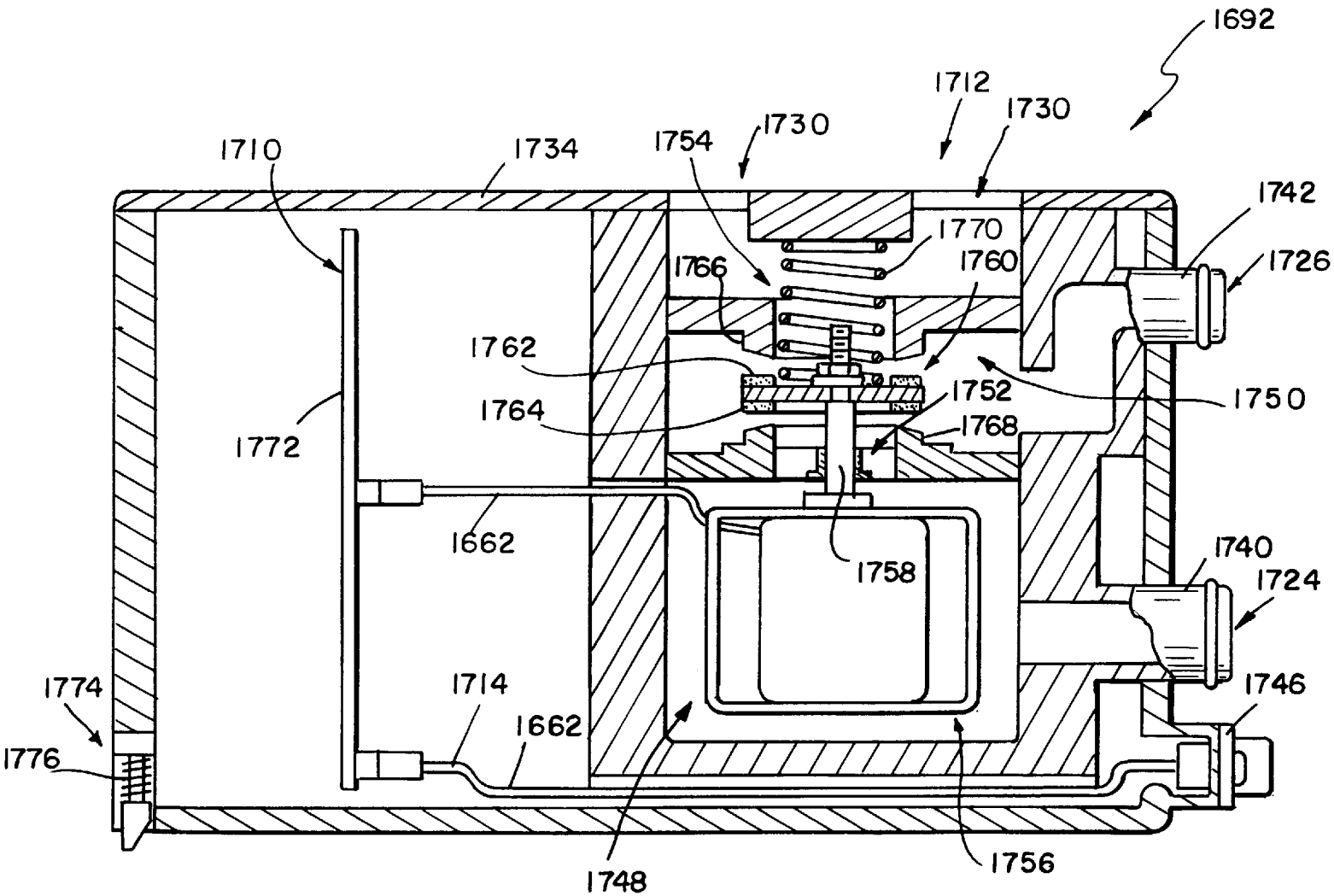
FIG. 33 is a sectional view of an embodiment of the percussion and vibration therapy module of FIG. 29 similar to the embodiment of FIG. 32.

A solenoid 1756 coupled to controller 1710 is positioned within pressure chamber 1748 and is coupled by a shaft 1758 to a valve plate 1760 that is positioned within bladder chamber 1750. Valve plate 1760 is illustratively a disc and includes top and bottom sealing gaskets 1762, 1764 that engage valve seats 1766, 1768 formed in bladder chamber 1750 as best shown in FIG. 33. Valve plate 1760 regulates flow through openings 1754, 1764. Solenoid 1756 can move valve plate 1760 between a first position on valve seat 1768 and a second position on valve seat 1766. In the first position, the valve plate 1760 prevents fluid communication from the air input port 1724 to the percussion and vibration bladder ports 1726, 1728 while providing an exhaust path through exhaust opening 1754 for to the percussion and vibration bladder ports 1726, 1728. In the second position, the valve plate 1760 prevents fluid communication from the air input port 1724 to the percussion and vibration bladder ports 1726, 1728 while closing exhaust opening 1754. Although a solenoid-driven valve assembly is shown, any valve design can be used to regulate flow of pressurized air, such as a cone valve, a spherical valve, butterfly valve, etc., and any electromechanical drive mechanism can replace solenoid 1756.

Valve assembly 1712 further includes a compression spring 1770 that biases valve plate 1760 toward valve seat 1768 so that when solenoid 1756 is inactive there will be no flow of air between pressure chamber 1748 and bladder chamber 1750. Again, any biasing assembly can be used, such as a ball-screw design, alternative spring configurations, etc.

Module 1692 further includes a circuit board 1772 coupled to housing 1734 that contains circuitry for controller 1710, which is illustratively microprocessor-based. Controller 1710 is coupled to communication network 1662 and to solenoid 1756 to regulate fluid communication from pressurized air input port 1724 to percussion and vibration bladder ports 1726, 1728.

Module 1692 also includes a latch 1774 that is biased by a spring 1776 to extend from a bottom back edge of housing 1734. Latch 1774 provides for holding module 1692 securely in place in a module-receiving manifold (not shown) similarly to latch 268 for module 203 discussed above for FIG. 25.

Although the invention has been described in detail with reference to certain preferred embodiments, variations and modifications exist within the scope and spirit of the present invention as described and defined in the following claims.

What is claimed is:

1. A percussion and vibration therapy apparatus having, in combination, a hospital bed and a module configured to be removably inserted into the hospital bed, the apparatus comprising:

the hospital bed including:

a receiving space configured to receive the module, an electrical communication network having at least one electrical connector, the connector being coupled to the receiving space, a pressurized air supply system having at least one pneumatic port, the pneumatic port being coupled to the receiving space, and at least one percussion and vibration bladder in fluid communication with a percussion and vibration port, the percussion and vibration port being coupled to the receiving space;

the module including:

a housing formed to be received in the receiving space, an electric circuit having an electrical connector coupled to the housing and configured to be coupled to the electrical connector on the bed, a pressurized air input port on the housing and configured to be coupled to the pneumatic port, a percussion and vibration bladder port on the housing and configured to be coupled to the percussion and vibration port, and a valve assembly coupled to the pressurized air input port and the percussion and vibration bladder port on the housing; and wherein, each port and electrical connector on the bed automatically mate with the each respective port and electrical connector on the module when the module is inserted into the receiving space.

2. The apparatus as in claim 1, further comprising a controller in the housing, coupled to the valve assembly and the electrical connector so as to regulate the flow of pressurized air through the valve assembly from the pressurized air input port to the percussion and vibration bladder port.

3. The apparatus of claim 2, further comprising an exhaust port coupled to the valve assembly, the valve assembly being configured to regulate flow of air from the percussion and vibration bladder port to the exhaust port.

4. The apparatus of claim 2, wherein the percussion and vibration bladder port comprises a pair of ports.

5. The apparatus of claim 2, further comprising a housing including an outside surface and an interior chamber, the valve assembly being coupled to the housing within the chamber.

6. The apparatus of claim 5, wherein the air input port comprises a tube extending from the outside surface of the housing.

7. The apparatus of claim 5, wherein the percussion and vibration bladder port comprises a tube extending from the outside surface of the housing.

8. The apparatus of claim 5, wherein the valve assembly comprises a solenoid coupled to a valve plate for movement of the valve plate between a first position to prevent fluid communication from the air input port to the percussion and vibration bladder port and a second position to permit fluid communication from the air input port to the percussion and vibration bladder port.

9. The apparatus of claim 8, wherein the valve assembly further comprises a spring that biases the valve plate to the first position.

10. The apparatus of claim 8, further comprising an exhaust port coupled to the valve assembly, and wherein the exhaust port is in fluid communication with the percussion and vibration bladder port when the valve plate is in the first position, and wherein the valve plate prevents fluid communication from the exhaust port to the percussion and vibration bladder port when the valve plate is in the second position.

11. The apparatus of claim 2, wherein the valve assembly includes a pressure chamber coupled to the pressurized air input port, a bladder chamber coupled to the percussion and vibration bladder port, and a valve to regulate fluid communication from the pressure chamber to the bladder chamber.

12. The apparatus of claim 11, wherein the valve assembly further includes an exhaust port coupled to the bladder chamber, and wherein the valve regulates fluid communication from the bladder chamber to the exhaust port.

13. The apparatus of claim 2, wherein the controller comprises an electronic circuit including a microprocessor configured to be coupled to the communication network and to the valve assembly to regulate fluid communication from the pressurized air input port to the percussion and vibration bladder port.

14. The apparatus of claim 13, wherein the valve assembly includes a bias assembly to bias the valve assembly to prevent fluid communication from the pressurized air input port to the percussion and vibration bladder port.

15. The apparatus of claim 14, wherein the valve assembly comprises a solenoid and a valve plate, and the bias assembly comprises a spring.

16. The apparatus of claim 2, wherein the bed includes a module-receiving manifold, and wherein the apparatus includes a latch to secure the apparatus to the manifold.

17. The apparatus as in claim 1, wherein mating of each port and electrical connector takes place substantially simultaneously upon insertion of the module into the receiving space.

18. The apparatus of claim 1, wherein the bed further comprises a valve on each pneumatic port, the valve including a biasing element such that the valve will remain closed when no module is within the receiving space, but will open when a module is inserted into the receiving space.

19. A percussion and vibration therapy apparatus having, in combination, a hospital bed and a module configured to be removably inserted into the hospital bed, the apparatus comprising:

the hospital bed including:

a receiving space configured to receive the module, an electrical communication network having at least one electrical connector coupled to the receiving space, a pressurized air supply system having at least one pneumatic port coupled to the receiving space, at least one percussion and vibration bladder in fluid communication with a percussion and vibration port and coupled to the receiving space;

the module comprising:

a housing formed to be received within the receiving space, at least a pressurized air input tubular port and a percussion and vibration bladder tubular port projecting from the housing along parallel axes and configured to be coupled to the pneumatic port and the percussion and vibration port of the bed respectively, an electrical connector coupled to the housing with an axis parallel with the axes of the tubular ports and configured to be coupled to the electrical connector on the bed; and a valve assembly within the housing and coupled to the tubular ports.

20. The apparatus of claim 19, wherein the valve assembly comprises a solenoid and a valve plate.

21. The apparatus of claim 20, wherein the valve assembly further comprises a valve seat to engage the valve plate to prevent fluid communication from the pressurized air input port to the percussion and vibration bladder port.

22. The apparatus of claim 21, wherein the valve assembly further comprises a spring to bias the valve plate toward the valve seat.

23. The apparatus of claim 21, wherein the valve assembly further comprises an exhaust port and a second valve seat to engage the valve plate to prevent fluid communication from the percussion and vibration bladder port to the exhaust port.

24. The apparatus of claim 19, wherein the valve assembly comprises an exhaust port.

25. The apparatus of claim 19, wherein the valve assembly comprises a bias assembly to bias the valve assembly to prevent fluid communication from the pressurized air input port to the percussion and vibration bladder port.

26. The apparatus of claim 19, wherein the bed further comprises a manifold body portion configured to have a plurality of receiving spaces, each receiving space configured to receive and mate with only a specific module.

27. A percussion and vibration therapy apparatus having, in combination, a hospital bed and a module configured to be removably inserted into the hospital bed, the apparatus comprising:

the hospital bed including:

a receiving space configured to receive the module, an electrical communication network having at least one electrical connector coupled to the receiving space, a pressurized air supply system having at least one pneumatic port coupled to the receiving space, at least one percussion and vibration bladder in fluid communication with a percussion and vibration port coupled to the receiving space;

the module comprising:

a housing formed to be received within the receiving space, a pressurized air input port on the housing and configured to be coupled to the pneumatic port, a percussion and vibration bladder port on the housing and configured to be coupled to the percussion and vibration port, means for regulating fluid communication from the pressurized air input port to the percussion and vibration bladder port, and means coupled to the communication network for controlling the means for regulating; and wherein, each port and electrical connector on the bed automatically mate with the each respective port and electrical connector on the module when the module is inserted into the receiving space.

28. The apparatus of claim 27, wherein the means for regulating comprises a solenoid coupled to a valve plate.

29. A pneumatic therapy apparatus having, in combination, a hospital bed and a module configured to be removably inserted into the hospital bed, the apparatus comprising:

the hospital bed including:

a receiving space configured to receive a plurality of specific modules at specific locations in the receiving space, an electrical connector at each location coupled to an electrical communication network, a supply port at each location coupled to a common pressurized air supply system, a bladder port at each location coupled to a bladder; and each module including:

a housing configured to be received at a specific location in the receiving space, an electrical connector coupled to the housing and configured to be coupled to the electrical connector on the bed, a pressurized air input port on the housing configured to be coupled to the pneumatic port, a bladder port on the housing configured to be coupled to the percussion and vibration port, and an electric valve assembly coupled to the pressurized air input and bladder ports and the electrical connector on the housing.

30. The apparatus of claim 29, wherein the receiving space includes a unique rib at each location and the module housing has a corresponding unique slot.

31. The apparatus of claim 30, wherein the rib and slot are unique by their position.

32. The apparatus of claim 29, wherein the location and the modules are color coded in different colors.

33. The apparatus of claim 29, including a lock securing the module in the receiving space.

34. The apparatus of claim 29, including a door covering the receiving space.

35. The apparatus of claim 34, including windows on the door at each location.

36. The apparatus of claim 29, further including a treatment module and a prevention module.

37. The apparatus as in claim 36, further including one or more percussion modules.

38. The apparatus of claim 36, further including one or more vibration modules.

39. The apparatus as in claim 38, further including one or more percussion modules.

* * * * *